United States Patent [19]

Jordan

[11] 4,188,925

[45] Feb. 19, 1980

[54] ENGINE CYLINDER VALVE CONTROL MECHANISM AND CYLINDER HEAD AND ENGINE INCORPORATING SAME

[76] Inventor: Edgar R. Jordan, 32260 W. 12 Mile Rd., Farmington, Mich. 48018

[21] Appl. No.: 872,983

[22] Filed: Jan. 27, 1978

Related U.S. Application Data

[63] Continuation-in-part of Ser. No. 805,198, Jun. 9, 1977, abandoned.

[51] Int. Cl.[2] ..... F01L 9/02

[52] U.S. Cl. ..... 123/90.12; 123/90.13; 123/90.15; 123/90.39; 123/90.41; 123/90.43

[58] Field of Search ..... 123/90.12, 90.13, 90.15, 123/90.16, 90.17, 90.39, 90.41, 90.43, 90.46

[56] References Cited

U.S. PATENT DOCUMENTS

| | | | |
|---|---|---|---|
| 1,491,023 | 4/1924 | Belden | 123/90.41 |
| 2,133,569 | 10/1938 | Price | 123/90.13 |
| 2,763,249 | 9/1956 | Flynn | 123/90.12 |
| 3,738,337 | 6/1973 | Massie | 123/90.12 |
| 3,872,844 | 3/1975 | Gates | 123/90.12 |
| 3,964,455 | 6/1976 | Brown | 123/90.43 |
| 4,009,695 | 3/1977 | Ule | 123/90.13 |
| 4,114,588 | 9/1978 | Jordon | 123/90.46 |

FOREIGN PATENT DOCUMENTS

| | | | |
|---|---|---|---|
| 1301334 | 8/1969 | Fed. Rep. of Germany | 123/90.13 |
| 1224168 | 3/1971 | United Kingdom | 123/90.12 |

*Primary Examiner*—Charles J. Myhre

*Assistant Examiner*—Jeffrey L. Yates

*Attorney, Agent, or Firm*—Reising, Ethington, Barnard, Perry & Brooks

[57] ABSTRACT

An engine valve operating mechanism for operating the poppet valves controlling the intake and exhaust ports of each cylinder independently of each other and independently of the crank shaft speed. The mechanism includes an extendable and retractable fluid actuator having first and second members telescopically engaged with each other, one of which members is rotatable with respect to the other. An expansible and contractable fluid chamber is defined between the members, and the flow of fluid into and out of the chamber is controlled in accordance with the angular position of the members with respect to each other. When fluid flows into the chamber, the chamber expands causing the actuator to extend. When fluid is exhausted from the chamber, the actuator contracts. The actuator is mounted on a support member and engages a poppet valve operator to cause a poppet valve engaged by the operator to move in opening and closing directions in response to extension and retraction of the actuator. The valve operating mechanisms can be mounted on cylinder heads of an engine, and an engine incorporating the invention includes a hydraulic system for maintaining a supply of hydraulic fluid to the valve operating mechanisms to permit the valve operating mechanisms to be operated independently of each other to vary the valve events or valve operations at each cylinder in accordance with performance requirements.

64 Claims, 24 Drawing Figures

ENGINE CYLINDER VALVE CONTROL MECHANISM AND CYLINDER HEAD AND ENGINE INCORPORATING SAME

This application is a continuation-in-part of application Ser. No. 805,198, filed June 9, 1977 now abandoned; entitled "Engine Cylinder Valve Control Mechanism", the entire disclosure of which is incorporated herein by reference.

TECHNICAL FIELD

This invention relates generally to internal combustion engines, and is particularly concerned with a mechanism for operating the poppet valves controlling the intake and exhaust ports of the engine cylinders in such a manner that the poppet valves can be operated independently of each other and independently of the speed or position of the crankshaft.

BACKGROUND ART

In conventional internal combustion engines, the intake and exhaust ports of each cylinder are controlled by poppet valves or the like which in turn are actuated by a camshaft driven by the crankshaft. Typically, the poppet valves are biased to a closed position relative to their respective ports and are positively actuated to an open position against the bias of the valve spring by cam lobes on the camshaft. The camshaft is usually drivingly engaged with the crankshaft by gearing so that the speed of the camshaft has a constant, fixed relationship to the speed of the crankshaft, e.g., the gearing between the crankshaft and camshaft may be such that the camshaft is driven at one-half the speed of the crankshaft. During rotation of the crankshaft, the various poppet valves move between their open and closed positions in a sequence and at speeds determined solely by the mechanical construction of the camshaft. All of the valve events, whether of an intake or exhaust poppet valve, are fixed mechanically with respect to the speed of the crankshaft and with respect to the angular position of the crankshaft with respect to some reference point. As used herein, the term "valve events" is meant to include the sequence of operation of the poppet valves, the crankshaft position at which each poppet valve opens and closes, the opening and closing rate of each poppet valve, the amount of opening of each poppet valve, and the dwell time of each poppet valve position.

It is apparent and has long been recognized that improved fuel economy, improved performance, and possible reduction in emissions could result if the valve events were not fixed mechanically with respect to the crankshaft speed and position, but instead could be made variable in accordance with the power requirements, independently of crankshaft speed.

Some modifications have been made to date in the valve events of prior art engines to obtain split engine performance by selectively disconnecting certain of the intake and exhaust poppet valves when the engine is at idle or cruising speed. See, for example, U.S. Pat. No. 3,974,455 of June 22, 1976, and the copending application Ser. No. 699,612 of Edgar R. Jordan, entitled "Valve Deactivator For Internal Combustion Engines", filed June 24, 1976, now U.S. Pat. No. 4,114,588. However, in the split engine arrangements, the only variation of the valve events possible is to selectively deactivate cylinders of the engine so that, for example, an eight cylinder engine can operate on four, six or eight cylinders depending on the engine load. The individual cylinders are either completely deactivated, or are completely activated. When activated, the intake and exhaust valves of the cylinder are again mechanically coupled to the crankshaft through the camshaft. This type of system is also discussed in the article by Larry Givens entitled "A New Approach to Variable Displacement", Automotive Engineering, May, 1977, Volume 85, No. 5, pages 30–34.

U.S. Pat. No. 4,009,695 of Mar. 1, 1977 discloses a programmed valve system for internal combustion engines utilizing two stage servo-valves for actuating the poppet valves controlling the intake and exhaust ports of the engine cylinders. The servovalves are mounted directly above the stem of the associated intake or exhaust poppet valves. When pressurized, a rod of the hydraulic servo-valve actuator extends to open the poppet valve against its valve spring, and the valve spring causes the valve to close when hydraulic pressure is removed permitting the rod to retract. The patent also discloses a computer for determining the signals to be transmitted to each of the servo-valves for actuating the intake or exhaust valves in accordance with varying conditions. The servo-valve actuator has one pintle controlled by a solenoid for admitting fluid into a chamber and another pintle controlled by another solenoid for exhausting fluid from the chamber so that the piston extends and retracts from the servo-valve in response to the admission and exhaustion of fluid from the chamber.

DISCLOSURE OF THE INVENTION

An object of this invention is to provide a valve operating mechanism for moving an engine poppet valve in opening and closing directions relative to the port controlled thereby which is of simplified, inexpensive construction, and which can be operated independently of crankshaft speed in accordance with engine power demands.

A further object is to provide an internal combustion engine having a fluid pressure valve operating mechanism for operating each poppet valve at an intake and exhaust port for each cylinder, in which a supply of fluid for operating each of the valve operating mechanisms is constantly available, and wherein the flow of fluid into and out of each of the valve operating mechanisms can be controlled independently such that the poppet valve controlled thereby opens and closes in response to signals to its valve operating mechanism independently of the engine speed or crankshaft position.

A further object is to provide engine valve operating mechanism for moving an engine poppet valve in opening and closing directions relative to the port controlled thereby that can be installed on existing engine constructions with a minimum amount of modification of the engine, and wherein the necessity for conventional crankshafts and push rods can be eliminated.

In carrying out the foregoing, and other objects, an engine valve operating mechanism according to the present invention includes an extendable and retractable fluid actuator having first and second members telescopically engaged with each other. The first member has an end wall with a cylindrical side wall, and the second member is slidably and rotatably received in the cylindrical side wall of the first member with an expansible and contractable fluid chamber defined between the opposed end walls of the two members. The two members are movable between extended and retracted positions with respect to each other in response to expansion and contraction, respectively, of the fluid chamber. Supply and exhaust ports control the flow of fluid into and out of the chamber in accordance with the angular position of the two members with respect to each other. The two telescopic members of the actuator are rotatable with respect to each other between a supply position to cause the chamber to expand from the contracted condition when fluid flows into the chamber from the supply port, and an exhaust position in which the fluid chamber is in fluid communication with the exhaust port to permit the chamber to contract from an expanded condition and also to prevent the chamber from being expanded from the contracted condition.

The second member is mounted on an actuator support member such that the first member moves toward and away from the second member as the actuator retracts and extends, respectively. A valve operator support member is spaced from the actuator support member, and a valve operator is mounted on the valve operator support member in such a manner as to be movable relative to the actuator support member in response to retraction and extension of the actuator. The valve operator engages the stem of a poppet valve, and extension of the actuator causes the valve operator to move in a poppet valve opening direction, and retraction of the actuator causes the valve operator to move in a poppet valve closing direction.

In several embodiments of the invention, the actuator support member is coaxial with the hydraulic actuator, and one of the telescopic members slides along the axis of the actuator support member to transmit the valve opening and valve closing movements to the valve operator. In another embodiment, the actuator support member extends transversely of the longitudinal axis of the actuator, and the position of the actuator along the length of the valve operator can be adjusted in accordance with engine operating conditions to vary the amount of movement of the valve as a function of the amount of extension or retraction of the actuator. Other objects, advantages and features of the invention will become apparent from the following description taken in connection with the accompanying drawings.

Figure 20:
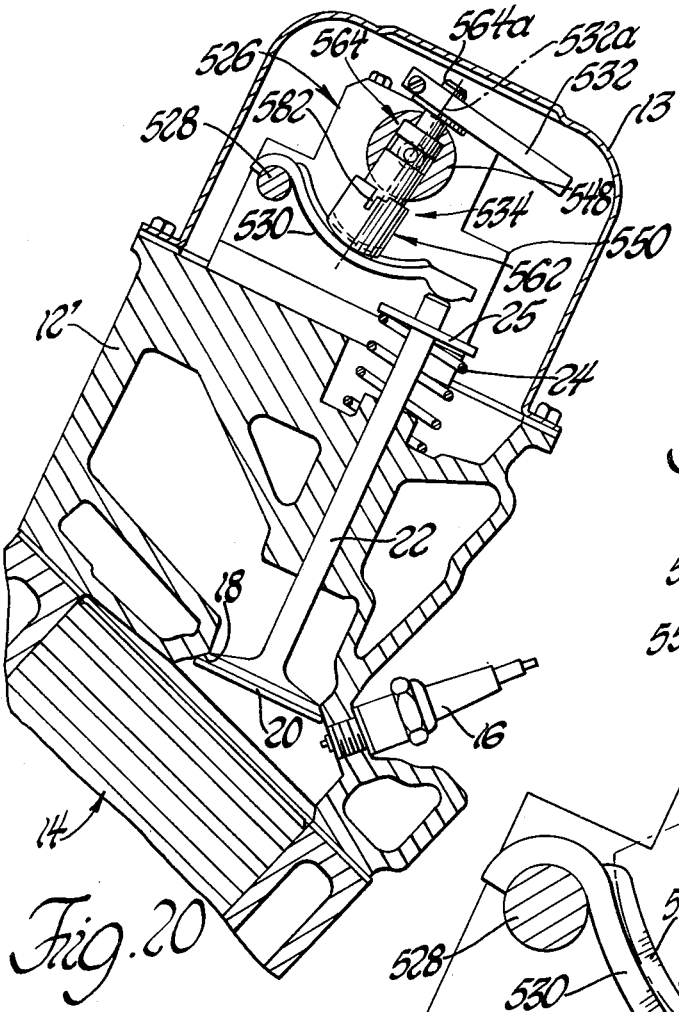
FIG. 20 is a view similar to FIG. 2 showing another form of engine valve operating mechanism embodying the present invention.
Figure 21:
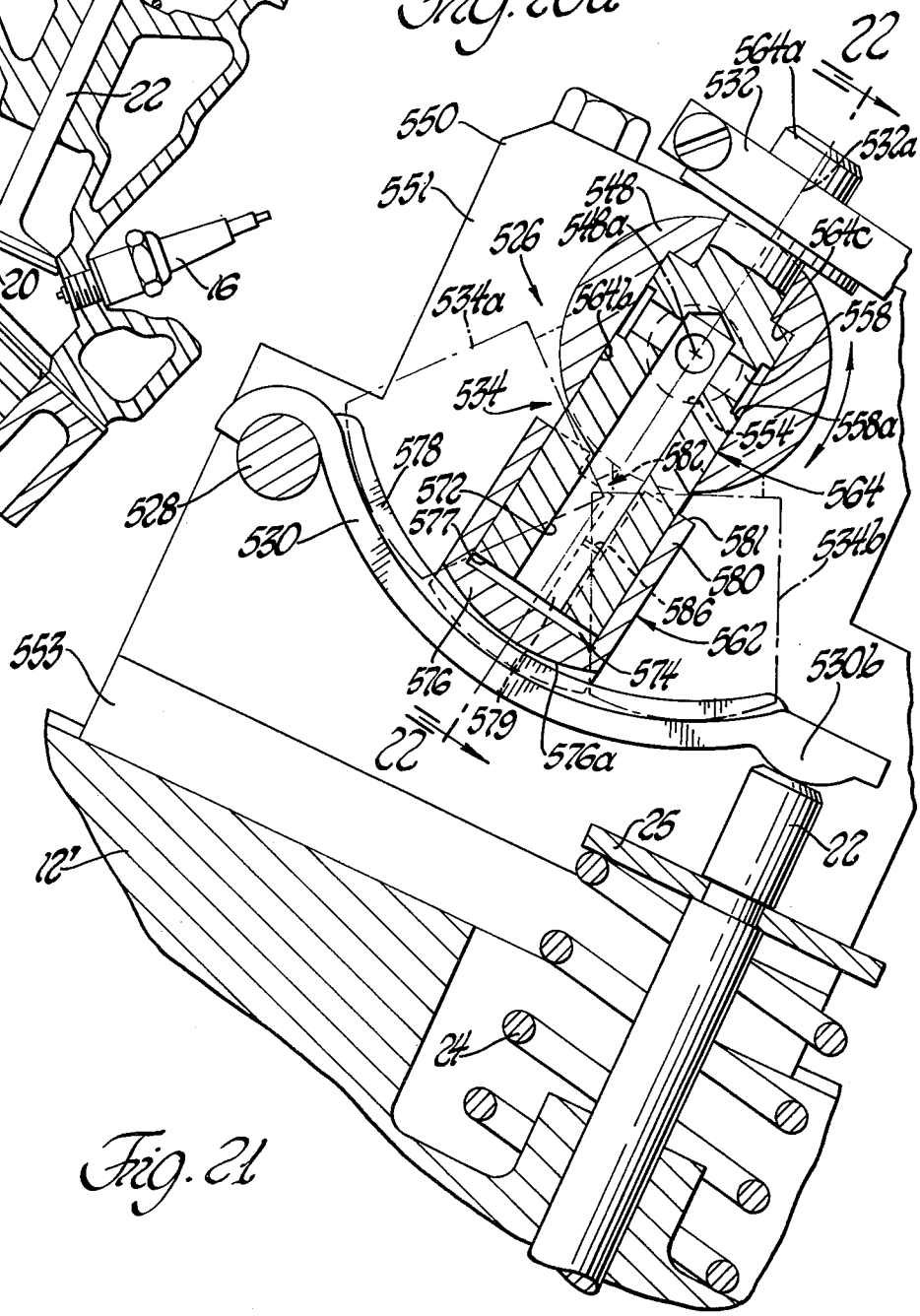
Figure 22:
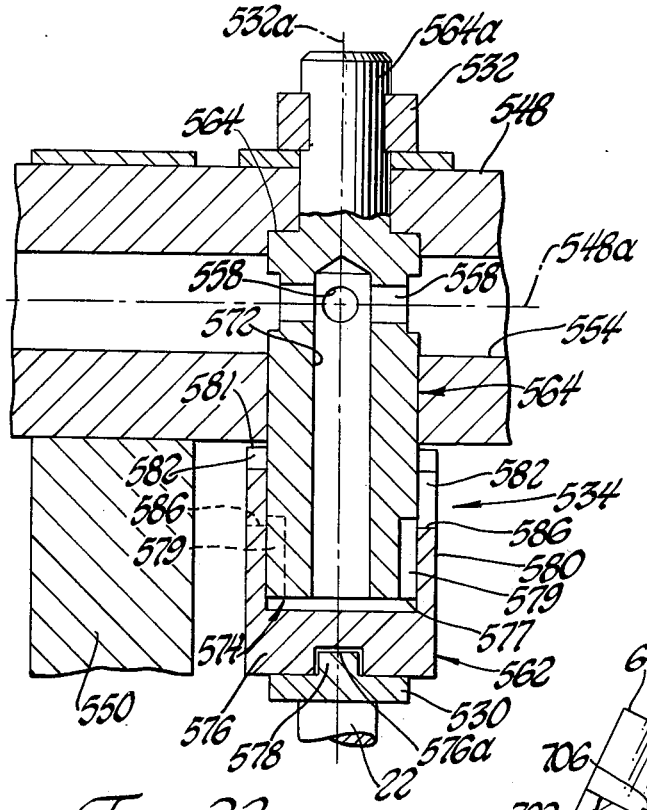

FIG. **20*a* is an enlarged fragmentary view showing a detail of FIG. 20**;

FIG. 21 is an enlarged view of the mechanism of FIG. 20 with parts of the mechanism shown in cross section and with certain parts shown in different positions in phantom lines;

FIG. 22 is a sectional view taken on lines 22—22 of FIG. 21; and

Figure 23:
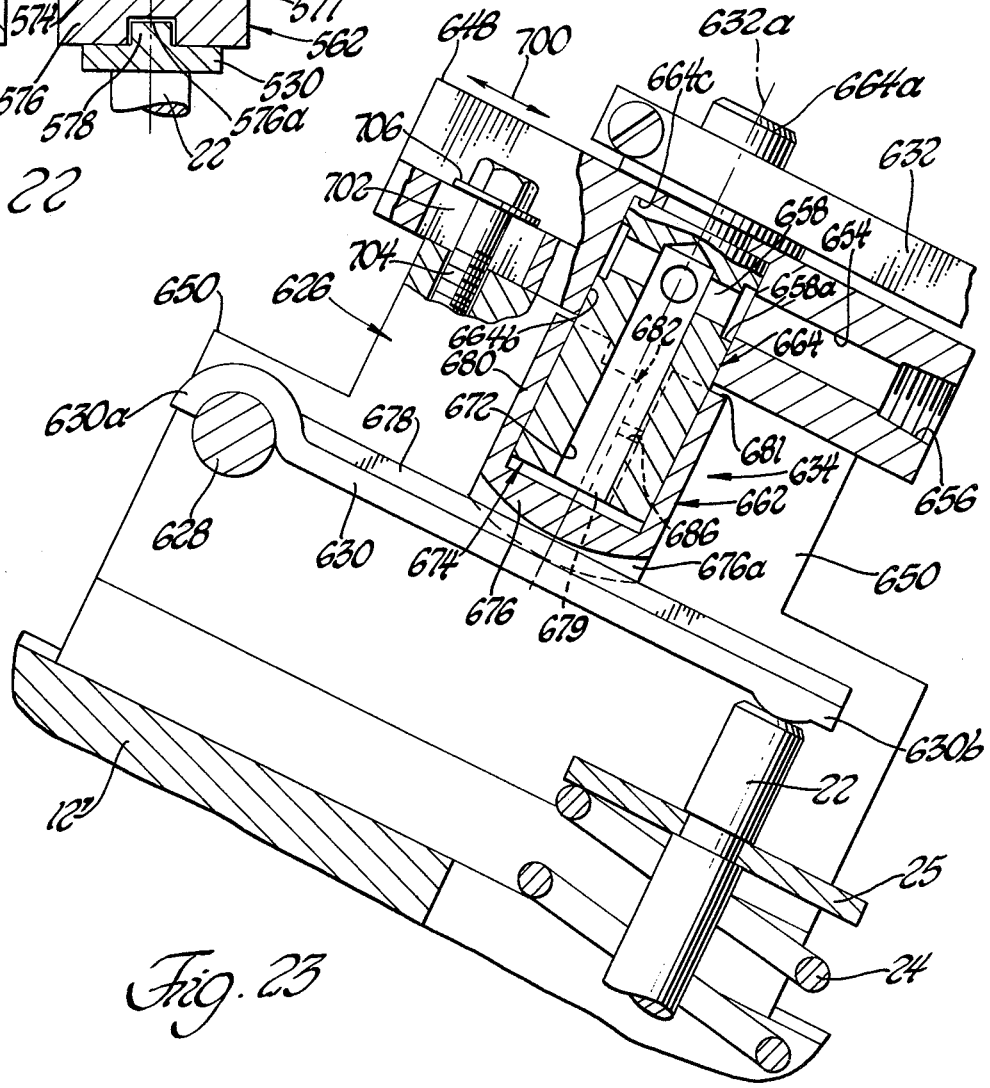

FIG. 23 is a view similar to FIG. 21 of a modified form of the mechanism shown in FIGS. 20–22.

BEST MODE FOR CARRYING OUT THE INVENTION

Figure 1:
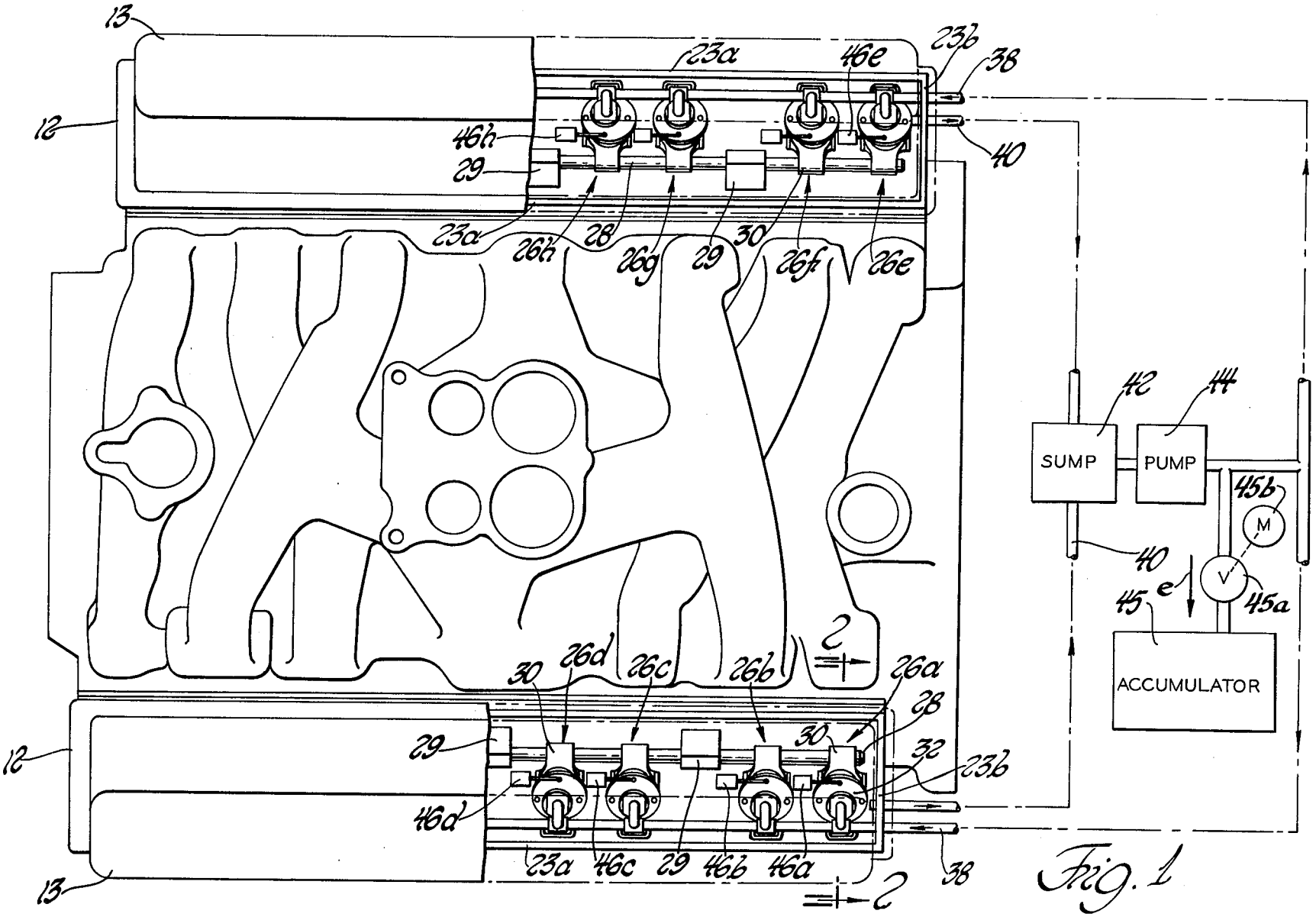
FIG. 1 is a top plan view, partially schematic, of an internal combustion engine embodying the present invention.
Figure 2:
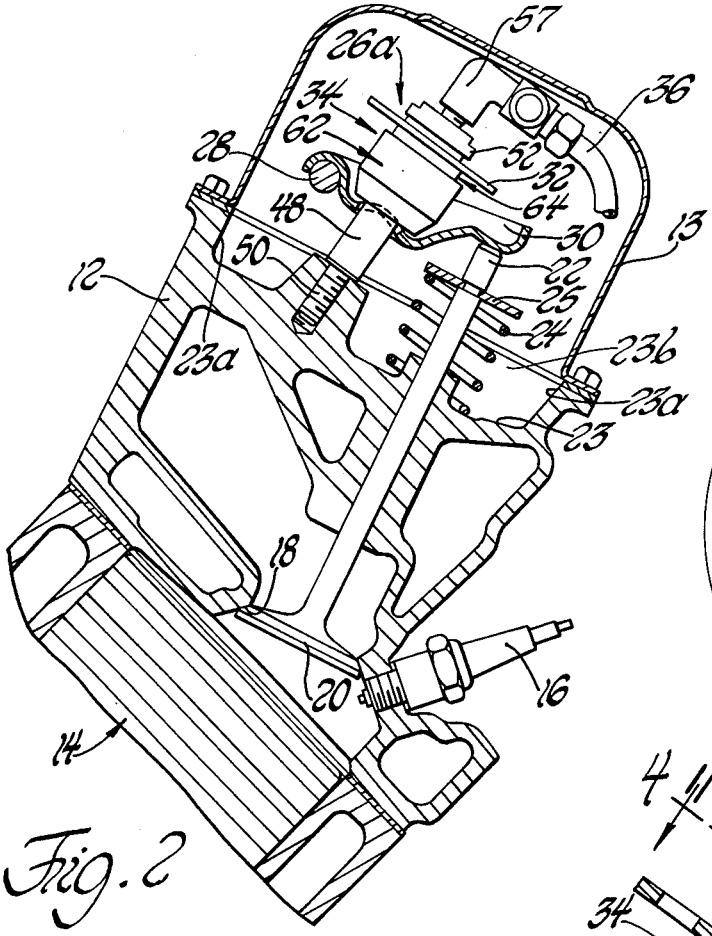
FIG. 2 is an enlarged sectional detailed view taken on lines 2—2 of FIG. 1 illustrating engine valve operating mechanism according to the present invention as installed on the cylinder head of the engine of FIG. 1.
Figure 4:
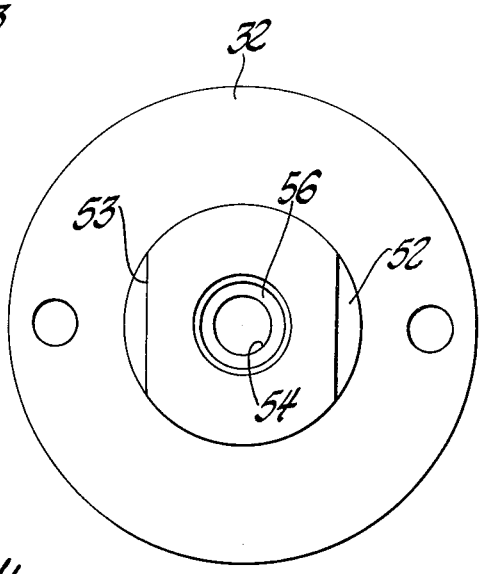
FIG. 4 is a top view of the mechanism of FIG. 3 taken on lines 4—4 of FIG. 3.

With reference to FIGS. 1 and 2, reference numeral 10 collectively designates a V-8 engine having a pair of cylinder heads each indicated by reference numeral 12. Each cylinder head 12 has a cover 13. The cylinder heads 12 each overlie a bank of four cylinders, one cylinder 14 being partially illustrated in FIG. 2.

The engine 10 is a conventional spark ignition V-8 engine, and a spark plug 16 is illustrated in FIG. 2 for igniting the fuel in the cylinder or combustion chamber 14. Each of the eight cylinders 14 of the engine 10 communicates with a pair of intake and exhaust ports formed in the cylinder head 12. One such cylinder head port 18 is illustrated in FIG. 2. The port 18 is controlled by an engine cylinder poppet valve 20 having a valve stem 22. The valve 20 is biased to the closed position against its port 18 by a spring 24 having one end seated against the upper surface 23 of the cylinder head, and its other end seated against a spring seat washer 25 secured to the stem 22 near the end thereof opposite the head of the valve 20.

In accordance with the present invention, each of the intake and exhaust poppet valves 20 is operated by an engine valve operating mechanism designated collectively by reference numeral 26. Two such valve operating mechanisms 26 are provided for each cylinder 14, one for actuating the poppet valve controlling the intake port of the cylinder, and one for operating the poppet valve controlling the exhaust port. In FIG. 1, engine valve operating mechanisms **26*a* and 26*b* are associated with the poppet valves controlling the intake and exhaust ports of one cylinder 14. The other illustrated pairs of valve operating mechanisms illustrated in FIG. 1 each operate the poppet valve controlling the intake or exhaust port of one of the eight cylinders 14 of the engine 10. Thus, the valve operating mechanisms 26***c* and *d* are associated with one cylinder 14, mechanisms 26*e* and *f* are associated with another cylinder 14, and mechanisms 26*g* and *h* are associated with another cylinder 14. The remaining valve operating mechanisms 26 are not visible in FIG. 1, the cover 13 of each cylinder head being only partially removed to show the valve operating mechanisms associated with four of the cylinders. FIGS. 2–8 illustrate the valve operating mechanism 26*a*, and the remaining valve mechanisms are of the same construction.

Reference numeral 28 indicates a valve operator support member which, in the embodiment illustrated in FIG. 1, is in the form of an elongated rod supported by brackets 29. The valve operator support rod 28 is held by the brackets 29 in fixed relationship with respect to its associated cylinder head 12 and the poppet valves 20 mounted thereon. The valve operating mechanism 26*a* (FIG. 2) includes a valve operator 30 having one end pivotally supported on the valve operator support member 28, and its other end engaged with the end of the stem 22 of valve 20. The valve operator 30 is pivotable about the rod 28 in a clockwise direction as viewed in FIG. 2 for a poppet valve opening operation, and in the opposite direction for a poppet valve closing direction. By valve opening direction, is meant the direction in which the poppet valve 20 is moved downwardly as viewed in FIG. 2 against the bias of spring 24 to open the port 18. By an engine valve closing operation is meant the valve operator 30 moves in a direction to permit the poppet valve 20 to seat against the port 18 to shut off the flow through the port.

In FIG. 2, the engine poppet valve 20 is shown in its closed position, and is held in the closed position by spring 24. The valve operating mechanism 26*a* includes an extendable and retractable fluid actuator 34 having a control member 32. The fluid actuator 34 is shown in its contracted condition in FIG. 2, and in an extended position in FIG. 5. When the fluid actuator 34 extends from the position shown in FIG. 2, it causes the engine valve operator 30 to pivot in a clockwise direction and open the poppet valve 20 relative to the cylinder head port 18.

The valve operating mechanism 26*a* is connected through a feed conduit 36 with a main supply conduit 38 (FIG. 1). Conduit 38 is connected with the output side of a pump 34, the intake side of which is connected with a tank or sump 42. Drain lines 40 connect each cylinder head 12 with the sump 42. The main supply conduit 38 is constantly pressurized by the pump 44 during operation of the engine. As is discussed in greater detail below, the fluid actuator 34 is connected with the conduits 36 and 38. When the control member 32 for the fluid actuator 34 is in a supply position, the fluid actuator 34 is caused to extend. When the control member 32 is in a drain or exhaust position, the fluid actuator 34 is caused to contract to the FIG. 2 position.

As shown in FIG. 1, each of the control members 32 are connected with input members 46. The input members 46 are illustrated schematically in FIG. 1, and may be solenoids or mechanical means which receive signals from an on-board computer on the vehicle to cause the associated control members 32 to move in accordance with the signals to the specific input members *46a–h*.

During engine operation, a source of fluid pressure is constantly available for each of the valve operating mechanisms 26. When the control member 32 for a valve operating mechanism is moved from the position illustrated in FIGS. 1 and 2 by its respective input member 46, the associated fluid actuator 34 is caused to extend and move its engine valve operator 30 in a valve opening direction until the input member 46 returns the control member 32 to the position shown in FIGS. 1 and 2. Each engine valve 20 is therefore independently controllable in accordance with the signal to its associated input member 46. The engine valve operating mechanisms 26 are thus operated independently of each other by the closed hydraulic system; the main supply line 38 is constantly pressurized by the pump 44 during operation.

The fluid flowing through the bleed ports and exhaust ports or the actuators 34 is collected on the surface 23 of the cylinder head 12 for return to the sump 42 through lines 40 (FIG. 1). The cylinder head 12 has a pair of spaced side walls 23*a* and a pair of spaced end walls 23*b* extending between the ends of the side walls 23*a* and projecting upwardly from the surface 23 (FIGS. 1 and 2). The drain line 40 has one end mounted in an opening in the end wall 23*b* adjacent to the sump and pump in FIG. 1.

With reference to FIGS. 2–8, the engine valve operating mechanism 26*a* includes an actuator support member or stud indicated by reference numeral 48. The actuator support member 48 has a threaded shank or stud portion 50 at its inner, lower end which is mounted in a threaded boss on the cylinder head so that the actuator support member 48 projects from the cylinder head between the valve operator support rod 28 and the stem 22 of the valve 20. The outer end of the actuator support member 48 is formed with a flange 52 having flat surfaces 53 (FIGS. 3 and 4) formed thereon for engagement by a tool for installing the actuator support member onto the cylinder head 12.

A fluid supply passage 54 is formed in the support member 48, and communicates with a tapped hole 56 at the outer end for engagement with a fluid connector 57 (FIG. 2). The connector 57 connects a feed conduit 36 with the supply passage 54. Cross ports 58 in the wall of the actuator support member 48 communicate with the supply passage 54 as shown particularly in FIGS. 5–7. The supply passage 54 also communicates with a reduced diameter bleed port 60 formed in the wall of the support member 48 (FIGS. 6 and 7).

The fluid actuator 34 includes first and second members 62 and 64, respectively, which are telescopically engaged with each other. In the illustrated embodiment, the first member 62 is in the form of a cylinder and is seated against the engine valve operator 30. The cylinder member 62 is axially movable along the length of the actuator support member 48. The second member 64 is in the form of a piston received in the cylinder member 62. The piston member 64 is rotatable about the axis of the actuator support member 48 but is restrained against axial movement with respect to the actuator support member 48. The piston member 64 is secured to the control member 32 by pins 66 such that rotation of the control member 32 about the longitudinal axis of the actuator support member 48 causes corresponding rotation of the piston member 64 about the actuator support member 48. Antifriction bearings 68 are interposed between the outer surface of the control member 32 and the lower surface of the flange 52. A C-ring or snap ring 70 is mounted in a groove in the actuator support member 48 (FIGS. 3 and 5) to support the piston member 64 against axial movement with respect to the actuator support member 48. The piston member 64 is formed with a pair of diametrically opposed supply ports 72.

The cylinder member 62 has an end wall 76 with a cylindrical side wall 80 projecting therefrom. In cross section, the supply ports 72 are L-shaped, with a trunk portion extending radially of the support member 48 to the side wall 80, and a branch portion depending from the trunk portion and communicating with the chamber 74. The piston member 64 is slidably and rotatably received in the cylindrical side wall 80 of the cylinder member 62 with its inner end disposed in opposed relationship to the inner surface of the end wall 76 to define an expansible and contractable fluid chamber 74 between the cylinder and piston members.

Figure 5:
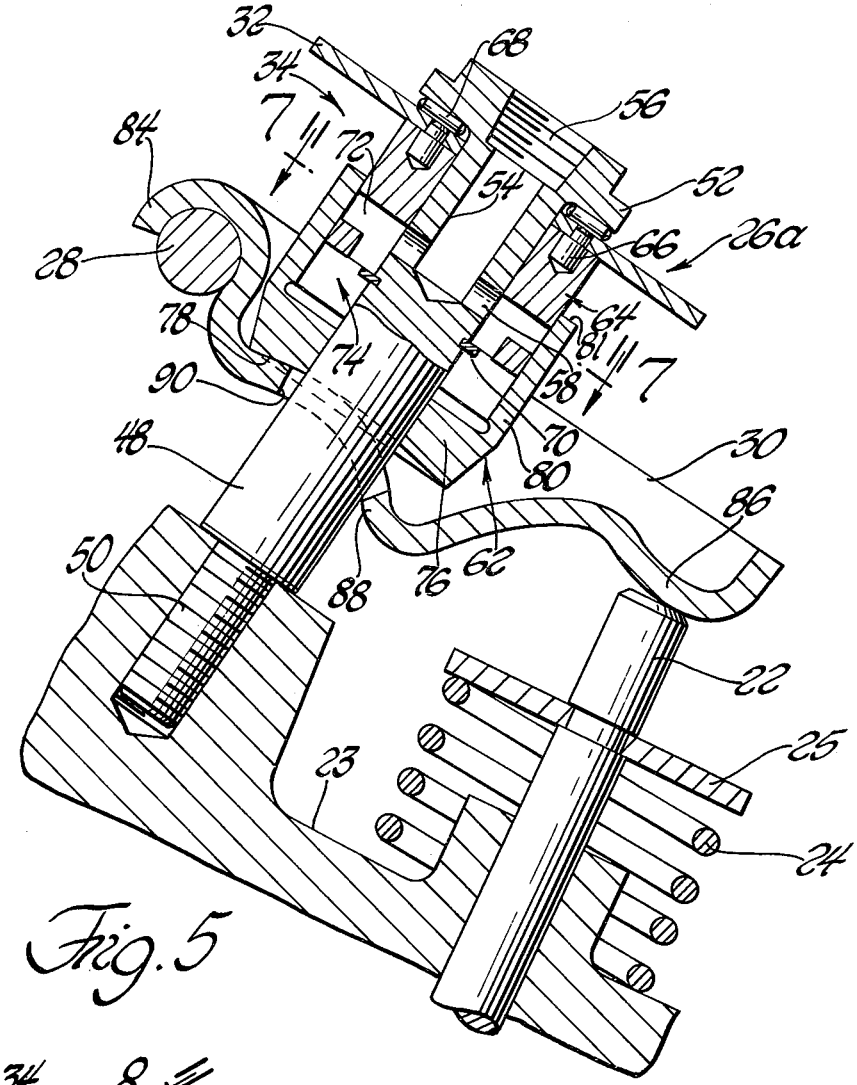
FIG. 5 is a view similar to FIG. 3 with the actuator portion of the mechanism extended to move the valve operator in an engine valve opening direction to open the poppet valve.
Figure 6:
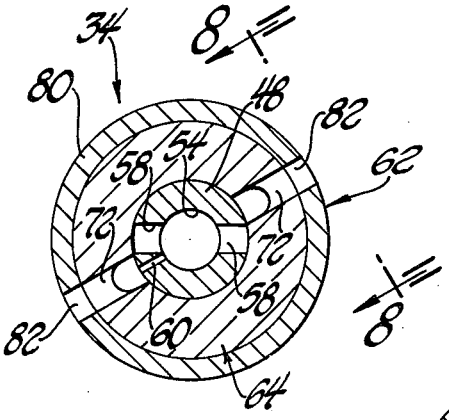
FIG. 6 is a sectional view taken on lines 6—6 of FIG. 3.
Figure 7:
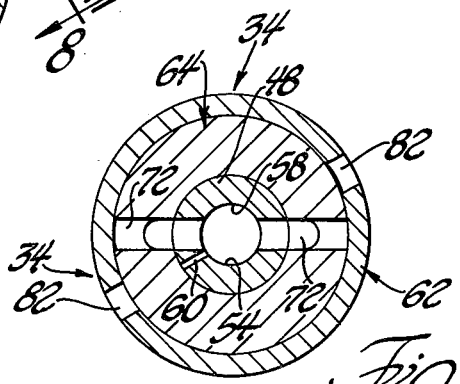
FIG. 7 is a view similar to FIG. 6 with the parts shown in a different position.
Figure 8:
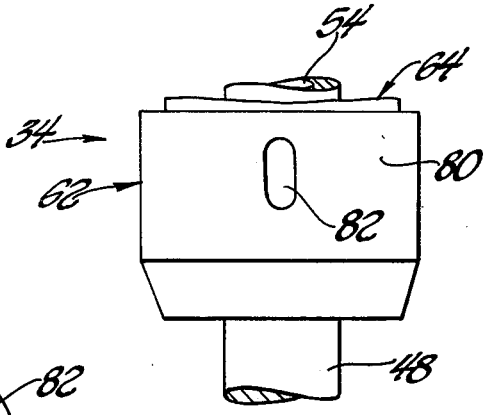
FIG. 8 is a view taken along lines 8—8 of FIG. 6.

In the embodiment illustrated in FIGS. 2–8, diametrically opposed exhaust ports 82 are formed in the side wall 80 of the cylinder member 62 of the fluid actuator 34. The cross ports 58, supply ports 72, and exhaust ports 82 are positionable with respect to each other to control the flow of fluid into and out of the fluid chamber 74. The supply and exhaust ports 72 and 82 in the fluid actuator members 62,64 are therefore operable to control the flow of fluid into and out of the fluid chamber 74 in accordance with the angular position of members 62 and 64 with respect to each other. The piston member 64 in the embodiment of FIGS. 2–8 is rotatable with respect to the cylinder member 62 between (1) a supply position shown in FIGS. 5 and 7 in which the chamber 74 is in fluid communication with the supply port 17 and in which fluid communication between chamber 74 and the exhaust ports 82 is blocked to cause the chamber 74 to expand from the contracted position of FIG. 3 to an extended position as shown in FIG. 5 when fluid is admitted thereto, and (2) an exhaust position shown in FIGS. 3 and 6 in which the fluid chamber 74 is in fluid communication with the exhaust ports 82 to permit the chamber 74 to contract from the expanded condition shown in FIG. 5, and to prevent the chamber 74 from being expanded from the contracted condition.

The lower surface 78 of the cylinder member 62 is concave and seats against an upper convex surface of the engine valve operator 30. The radius of curvature of the concave lower surface 78 of the end wall 76 of member 62 is such as to provide sufficient frictional contact between member 62 and engine valve operator 30 as to prevent rotation of member 62 with respect to the engine valve operator 30. Consequently, the cylinder member 62, and hence the exhaust ports 82, have a fixed angular position with respect to the longitudinal axis of the actuator support member 48, which position is shown in FIGS. 6 and 7. It is, of course, within the scope of the invention to provide means other than the frictional contact between the valve operator 30 and the lower surface 78 of the end wall 76 to prevent rotation of the cylinder member 62 with respect to the actuator support member 48.

Figure 3:
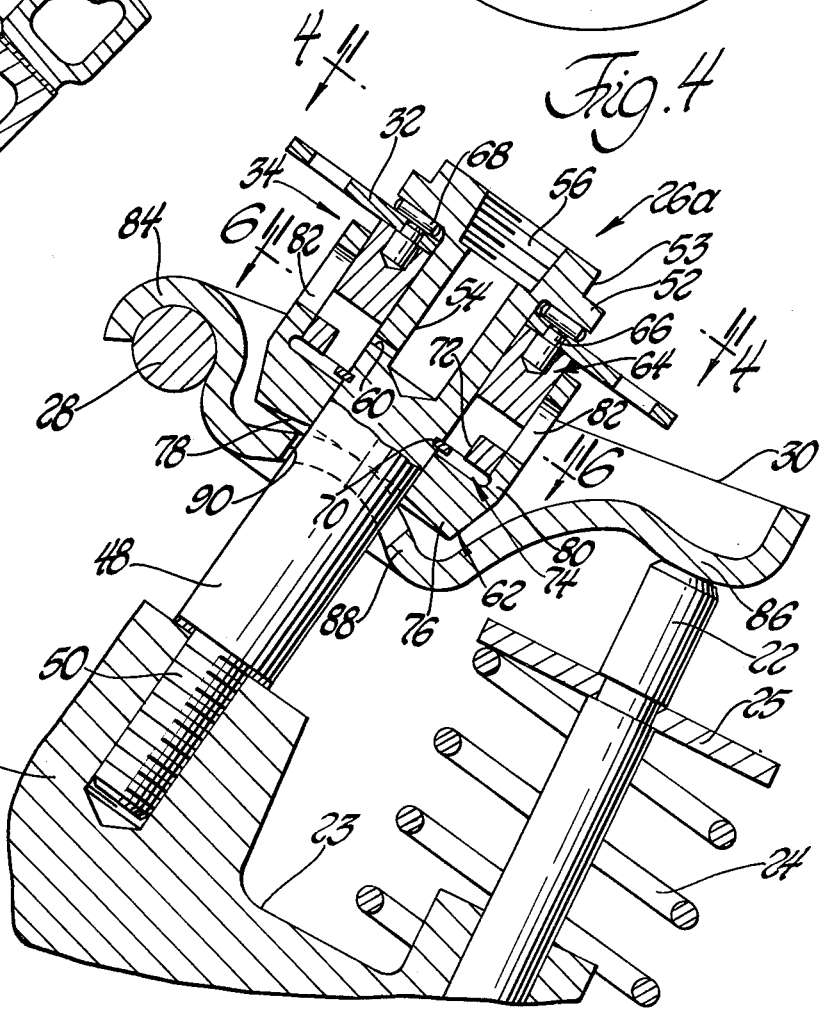
FIG. 3 is an enlarged cross-sectional view of the engine valve operating mechanism shown in FIG. 2 with the mechanism in the position permitting the engine valve to close.

As shown in FIGS. 3 and 5, the engine valve operator 30 includes a hinge portion 84 at one end that is pivotally supported on the valve operator support rod 28. The other end 86 of the valve operator 30 engages the end of the poppet valve stem 22. The valve operator 30 includes a central portion 88 that is dished upwardly in FIGS. 2, 3, and 5 with a slot 90 formed therein for receiving the actuator support member 48.

FIGS. 3 and 6 illustrate the exhaust position of members 62 and 64 with respect to each other. In the exhaust position, fluid flow from supply passage 54 through the cross ports 58 is blocked as shown in FIG. 6, and the supply ports 72 communicate directly with the exhaust ports 82. Consequently, the fluid chamber 74 contracts because of the bias of the poppet valve spring 24 which causes the engine valve operator 30 to push member 62 upwardly along the longitudinal axis of the actuator support member 48 to contract the chamber 74 and cause any hydraulic fluid therein to be exprlled through the exhaust ports 82. In the exhaust position, the bleed port 60 communicates with the supply ports 72 to prevent excessive pressure in the hydraulic system.

When the control member 32 is actuated to rotate the piston member 64 relative to the cylinder member 62 to the supply position illustrated in FIGS. 5 and 7, the fluid chamber 74 is blocked from communication with the exhaust ports 82, and the supply ports 72 communicate with the cross ports 58 to permit fluid to flow into chamber 74 causing it to expand. Expansion of chamber 74 causes axial movement of member 62 and corresponding clockwise movement of the valve operator 30 from the position shown in FIG. 3 to compress spring 24 and open the poppet valve 20 by moving the valve stem 22 downwardly as shown in FIG. 5.

Thus, oscillation of the fluid actuator piston member 64, which may be considered to serve as a control valve for the actuator, between the positions illustrated in FIGS. 6 and 7, causes reciprocation of the cylinder member 62 along the longitudinal axis of the actuator support member 48 between contracted and extended positions as illustrated respectively in FIGS. 3 and 5. For a typical V-8 engine, the actuator should be capable of extending and retracting as shown in FIGS. 5 and 3 for at least 2,000 cycles per minute. The maximum stroke of the cylinder member 62 with respect to the piston member 64 may be, for example, on on the order of 0.160 inches to cause the poppet valve 20 to move from the seat 18 a distance of 0.440 inches, for example. It has been found to date that with adequate hydraulic pressure (of approximately 700 to 1200 psi., for example) present at the supply passage 54, the control member 32 (and hence the piston member 64 of the actuator 34) can be oscillated about the axis of the support member 48 between the supply and exhaust positions of up to 3,000 cycles per minute to cause reciprocation of the cylinder member 62 of the actuator 34 a corresponding number of cycles between the retracted and extended positions of FIGS. 3 and 5, respectively. The foregoing figures are given by way of explanation and example only, and are not limitations on the scope of the invention.

In the engine shown in FIG. 1, an accumulator 45 may be used to store hydraulic energy when the engine is shut down. Crankshaft rotation can be started by means of an electric starter, for example, with all of the poppet valves 20 closed against their respective seats 18 to substantially reduce the torque requirements of the starter. After crankshaft rotation is accomplished, the accumulator may be opened to pressurize the main hydraulic supply conduits 38 to permit actuation of the poppet valves 20. The input members 46 may be electric, hydraulic, mechanical or a combination of these. In any case, the input members 46 will respond to electronically determined signals based upon the difference between engine performance and engine demand. The system also permits deactivation of some of the poppet valves 20 as desired for so-called "split engine" operation. For example, at idle or cruising speeds, as determined by the on-board computer, the intake and exhaust poppet valves for certain ones of the cylinders can be signalled to remain closed until the power demands on the engine increase. As a result, the eight cylinder engine depicted may operate at idle or cruising speed with fuel being consumed only by certain active cylinders, the remaining cylinders being deactivated as a result of the input members 46 remaining in the exhaust position permitting the respective poppet valves 20 to be held in their closed positions by the springs 24.

Figure 9:
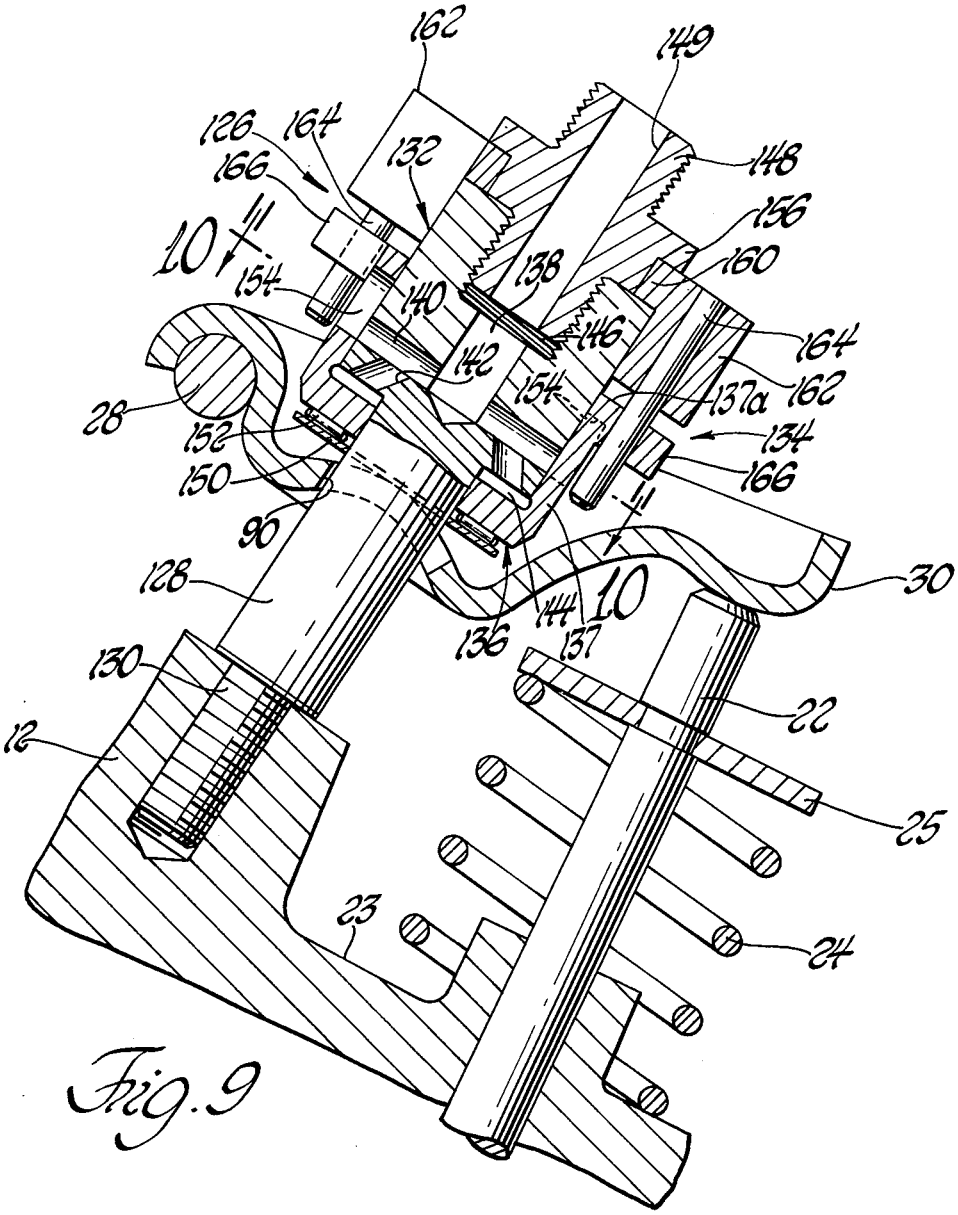
FIG. 9 is a view similar to FIG. 3, taken on lines 9—9 of FIG. 10, showing another form of engine valve operating mechanism embodying the present invention.
Figure 10:
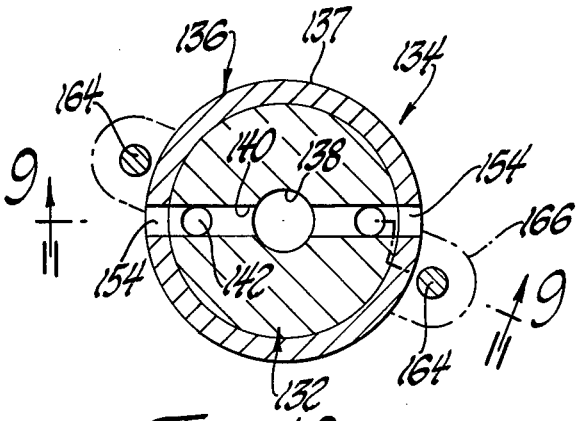
FIG. 10 is a sectional view taken on lines 10—10 of FIG. 9.
Figure 11:
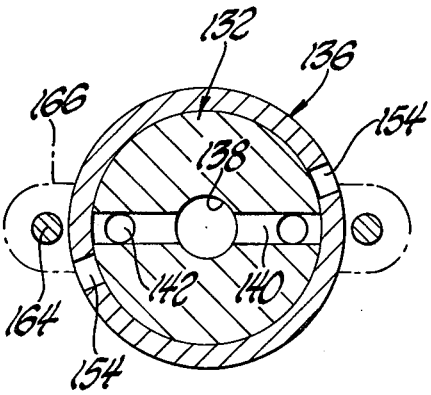
FIG. 11 is a view similar to FIG. 10 with the parts shown in a different position.

FIGS. 9–11 illustrate another form of engine valve operating mechanism embodying the present invention. In FIG. 9, the engine valve operating mechanism is designated collectively by reference numeral 126, and the mechanism 126 may be considered to be mounted on the same engine construction as shown in FIGS. 1 and 2. FIG. 9 shows the same cylinder head 12, valve operator support rod 28, poppet valve stem 22 and poppet valve spring 24 as is illustrated in FIGS. 2 and 3.

The valve operating mechanism 126 includes an actuator support member 128. The actuator support member 128 has a threaded shank or stud portion 130 at its inner end which is mounted in an internally threaded boss on the cylinder head 12 as is the case with the actuator support member 48 of the previously described embodiment. The valve operating mechanism 126 also includes a valve operator 30 of the same construction as the valve operator 30 in the previously described embodiment. The actuator support member 128 projects through the slot 90 formed in the valve operator 30.

The mechanism 126 includes an extendable and retractable fluid actuator 134 having first and second members 136 and 132, respectively, telescopically engaged with each other. In the illustrated embodiment, member 136 is a cylinder member, and member 132 is a piston member slidably receiving the cylinder member 136. The piston member 132 is integrally formed as an enlarged portion on the outer end of the actuator support member 128. The supply passage 138 is formed in the piston member 132, and hence the actuator support member 128, and communicates with a supply port 140 formed in the piston member 132. The supply port has a radially extending trunk portion 140 and a branch portion 142 which connects the trunk portion with an expansible and contractable fluid chamber 144 formed between members 136 and 132.

The supply passage 138 communicates with a tapped hole 146 at the outer end of the actuator support member 128. A fluid fitting 148 has one end threadedly mounted in the tapped hole 146. Fitting 148 has a central passage 149 which communicates with the supply passage 138. The fitting 148 has an outer threaded end for engagement with the fluid connector shown in FIG. 2 for conducting fluid through the feed conduit 36 to the supply passage 138.

The cylinder member 136 is seated on thrust bearings 152, which in turn are seated on a hardened steel washer 150 so that the cylinder member 136 is freely rotatable about the axis of the actuator support member 128. A pair of diametrically opposed exhaust ports 154 are formed in the cylindrical side wall 137 of the cylinder member 136.

In the embodiment of FIGS. 9–11, the supply and exhaust ports 140, 142, and 154 in the members 132 and 136 are operable to control the flow of fluid into and out of the fluid chamber 144 in accordance with the angular position of members 132 and 136 with respect to each other. In the embodiment of FIGS. 9–11, cylinder member 136 operates as a control valve for the fluid actuator 134. Since the piston member 132 is fixed to the actuator support member 128, the cylindrical side wall 137 of member 136 slidably and rotatably receives the piston member 132. The piston member 132 and the cylinder member 136 are rotatable with respect to each other between (1) a supply position on which the chamber 144 is in fluid communication with the supply ports 140 and 142, and in which fluid communication between chamber 144 and the exhaust ports 154 is blocked (the FIG. 11 position) to cause the chamber 144 to expand from the contracted condition shown in FIG. 9 when fluid flows into chamber 144 from the supply port branch portion 142; and (2) an exhaust position in which the fluid chamber 144 is in fluid communication with the exhaust port 154 (the FIG. 10 position) to permit the chamber 144 to contract from the expanded condition and to prevent the chamber 144 from being expanded from the contracted condition. When the fluid chamber 144 expands, the cylinder member 136 of the actuator 134 moves down the actuator support member 128 to cause clockwise rotation of the valve operator member 30 about its support member 28 to depress the poppet valve stem 22 against the poppet valve spring 24. Thus, when the cylinder member 136 is rotated to the supply position of FIG. 11, fluid flows into the chamber 144 to cause the actuator 134 to extend and move the valve operator 30 in a poppet valve opening direction against spring 24. When the cylinder member 136 is returned to the exhaust position of FIG. 10, fluid is exhausted from the fluid chamber 44 to permit the actuator 134 to contract to the FIG. 9 position, and fluid from the supply passage 138 flows directly through ports 140 and out of the exhaust ports 154. Spring 24 causes the valve operator 30 to move in a vlave closing direction as the poppet valve seats against port 18 (FIG. 2).

The fitting 148 is formed with a retaining flange 156 which overlies a control member 160. The control member 160 is rotatable about the axis of the actuator support member 128. The control member 160 is formed with a pair of lugs 162 projecting outwardly from the periphery of the control member in diametrically opposed relationship to each other. Pins 164 are mounted in the lugs 162. The actuator control valve member 136 is formed with diametrically opposed lugs 166 each of which has an opening for slidably receiving one of the pins 164. The pins 164 comprise connecting means connecting the control member 162 with the actuator control valve member 136 to cause the actuator member 136 to rotate with the control member about the axis of the support member 128 but permit the actuator member 136 to slide along the actuator support member 128 with respect to the control member, and with respect to the actuator member 132. Rotation of the control member 160 in a counterclockwise direction from the position of FIGS. 9 and 10 causes the exhaust ports 154 to move from the exhaust position to the supply position illustrated in FIG. 11. When the control valve 136 is in the supply position of FIG. 11, the exhaust ports 134 are blocked from communication with the supply passage 138, as pointed out previously, and the fluid chamber 144 expands to cause the actuator 134 to extend resulting in member 136 moving toward the cylinder head 12 and causing the valve operator 30 to pivot clockwise about rod 28 in a poppet valve opening direction against spring 24. Member 136 thus slides along the axis of the support member 128 and along the length of the pins 164.

In the embodiment of FIGS. 9–11, as well as in the embodiment of FIGS. 3–8, one factor in determining the difference between the extended and retracted lengths of the actuators 34 and 134 is the lengths of the exhaust ports 82 and 154 in the direction parallel to the longitudinal axis of the actuator support members 48 and 128. For example, in FIG. 3, when the fluid chamber 74 is contracted, each supply port 72 communicates with the lower end of the exhaust ports 82. When the piston member 64 is rotated to the supply position of FIGS. 5 and 7, chamber 74 expands as shown in FIG. 5. When the piston member is then rotated back to the exhaust position, the supply port 72 communicates with the exhaust port 82 near the upper end thereof to permit the escape of fluid from chamber 74 so that the actuator 34 will contract to the FIG. 3 length. Under normal operating conditions, the rate of flow of fluid into the chamber 74 in the supply position of FIGS. 5 and 7, and the time of each cycle of oscillation of the piston member 64 between the positions of FIGS. 6 and 7, is such that the piston returns to the exhaust position when the extended length of the actuator 34 is such that the supply ports 72 will communicate with the upper end of the exhaust port 82 when the actuator is extended approximately to the position shown in FIG. 5. However, the actuator 34 is self-relieving when the upper edge 81 (FIG. 5) of the cylinder member 62 clears the supply port 72. Thus, the actuator 34 cannot extend beyond the length at which the upper edge 81 of the cylindrical wall 80 clears the supply port 72 to permit the escape of fluid over the edge of the side wall 80. The embodiment of FIGS. 9–11 operates in a similar manner to limit the extended length of the actuator. The actuator 134 is self-relieving in the sense that it cannot extend beyond the length at which the upper edge 137*a* of the side wall 137 clears the supply port portion 140 to permit the escape of fluid from chamber 144.

In the embodiments of FIGS. 5–8 and 9–11, the length of the stroke of the actuator can be varied only by changing the speed of oscillation of the control valve member between the supply and exhaust positions, assuming a constant pressure in the hydraulic system. For example, in the FIGS. 3–8 embodiment, the length of the stroke of the actuator is decreased when the speed of oscillation of the control valve member 64 between the positions of FIGS. 6 and 7 is increased. The reason is that, as the supply port 72 moves from the FIG. 7 to the FIG. 6 position, it will communicate with the exhaust port 82 at a position nearer to the lower end of the exhaust port 82 as viewed in FIG. 8. By decreasing the speed of oscillation of the control valve member 64, the fluid chamber 74 will have a greater time to expand before the supply port 72 returns to the FIG. 6 position in communication with the exhaust port 82. The same is true with the embodiment of FIGS. 9–11.

Figure 12:
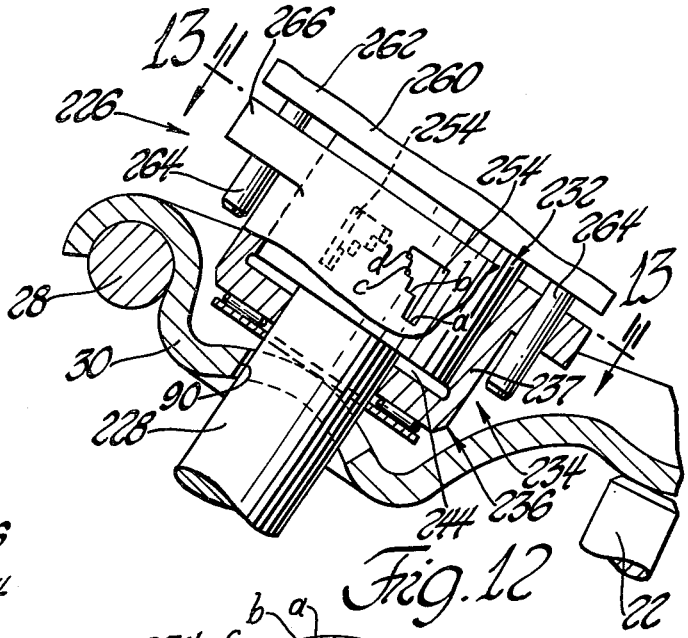
FIG. 12 is a fragmentary view similar to FIG. 9 showing a modified form of the mechanism of FIG. 9.
Figure 13:
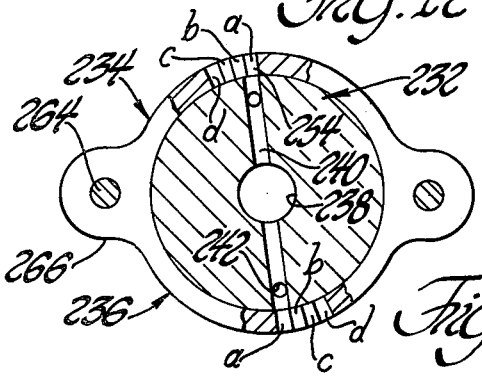
FIG. 13 is a sectional view taken along lines 13—13 of FIG. 12.

FIGS. 12 and 13 illustrate a modified version of the embodiment of FIGS. 9–11 wherein the length of the stroke of the actuator is determined by the angular position of the actuator members with respect to each other. The actuator is self-relieving at different lengths depending upon the angular position of the two actuator members with respect to each other.

In FIG. 12, the engine valve operating mechanism is designated collectively by reference numeral 226, and may be considered to be mounted on the same engine construction as shown in FIGS. 1 and 2 for purposes of description. The valve operating mechanism 226 includes an actuator support member 228 having a threaded shank or stud portion (not shown) at its inner end which is mounted in an internally threaded boss on the cylinder as is the case with the support member 128 of FIG. 9. The valve operating mechanism 226 also includes a valve operator 30 of the same construction as the valve operator 30 of FIG. 9. The actuator support member 228 projects through the slot 90 formed in the valve operator 30.

The mechanism 226 includes an extendable and retractable fluid actuator 234 having first and second members 236 and 232, respectively, telescopically engaged with each other. Member 236 is a cylinder member, and member 232 is a piston member. The piston member 232 is integrally formed as an enlarged portion of the outer end of the actuator support member 228 as in the FIG. 9 embodiment. As in FIG. 9, a supply passage 238 is formed in the piston member 232, and communicates with a supply port having a radially extending trunk portion 240 and a branch portion 242. The portion 242 of the supply port connects the trunk portion 240 with the expansible and contractable fluid chamber 244 defined between the piston and cylinder members 232 and 236.

The cylinder member 236 is seated on thrust bearings 252, which in turn are seated on a hardened steel washer 250 as in the case of the embodiment of FIGS. 9–11. A pair of diametrically opposed exhaust ports 254 are formed in the side wall 237 of the cylinder member 236. The exhaust ports 254 have a stepped configuration; that is, the lower edge of each exhaust port 254 has four steps or levels indicated at a, b, c, and d.

As in the FIG. 9–11 embodiment, the cylinder member 236 operates as a control valve for the fluid actuator 234. Since the piston member 232 is fixed to the actuator support member 228, the cylindrical side wall 237 slidably and rotatably receives the piston member 232. The piston member 232 and the cylinder member 236 are rotatable with respect to each other between (1) a supply position in which the chamber 244 is in fluid communication with the supply ports 240 and 242, and in which fluid communication between chamber 244 and the exhaust ports 254 is blocked to cause the chamber 244 to expand from the contracted condition shown in FIG. 12 when fluid flows into chamber 244 from the supply port branch portion 242; and (2) an exhaust position in which the fluid chamber 244 is in fluid communication with level a of the exhaust port 254 to permit the chamber 244 to contract from the expanded condition and to prevent the chamber 244 from being expanded from the contracted condition. When the fluid chamber 244 expands, the cylinder member 236 moves down the actuator support member 228 to cause clockwise rotation of the valve operator member 30 about its support member 28 to depress the poppet valve stem 22 against spring 24.

Although the control valve member 236 in FIGS. 12 and 13 is rotatable between supply and exhaust positions as is the case with the control valve member 136 of FIGS. 9–11, the control valve member 236 has three distinct supply positions, and the length of the stroke of the actuator 234 is dependent upon which of the three supply positions the control valve member 236 is in.

The control valve member 236 is shown in the exhaust position in FIGS. 12 and 13. In the exhaust position, port 240 communicates with the exhaust port 254 at step a. Consequently, the chamber 244 cannot expand because it communicates through ports 242 and 240 with the lowest step a of the exhaust port 254; any fluid from supply passage 238 also flows directly out of the exhaust port 254 over the step a.

Clockwise rotation of the control valve member 236 from the exhaust position shown in FIG. 13 moves the parts to a supply position to cause extension of the actuator 234. If member 236 is rotated to align the supply passage 240 with step b of the exhaust ports, the actuator will extend until step b of the exhaust port 254 clears the supply port 240. The extended length of the actuator is self-limiting because of the self-relieving of the fluid chamber through the supply port 240 over the edge of step b. Thus, the length of the stroke of the actuator when the cylinder member 236 is rotated from the exhaust position as shown in FIGS. 12 and 13 is determined by the angular position of the cylinder member 236 with respect to the piston member 232 about the longitudinal axis of the support member 228.

Figure 14:
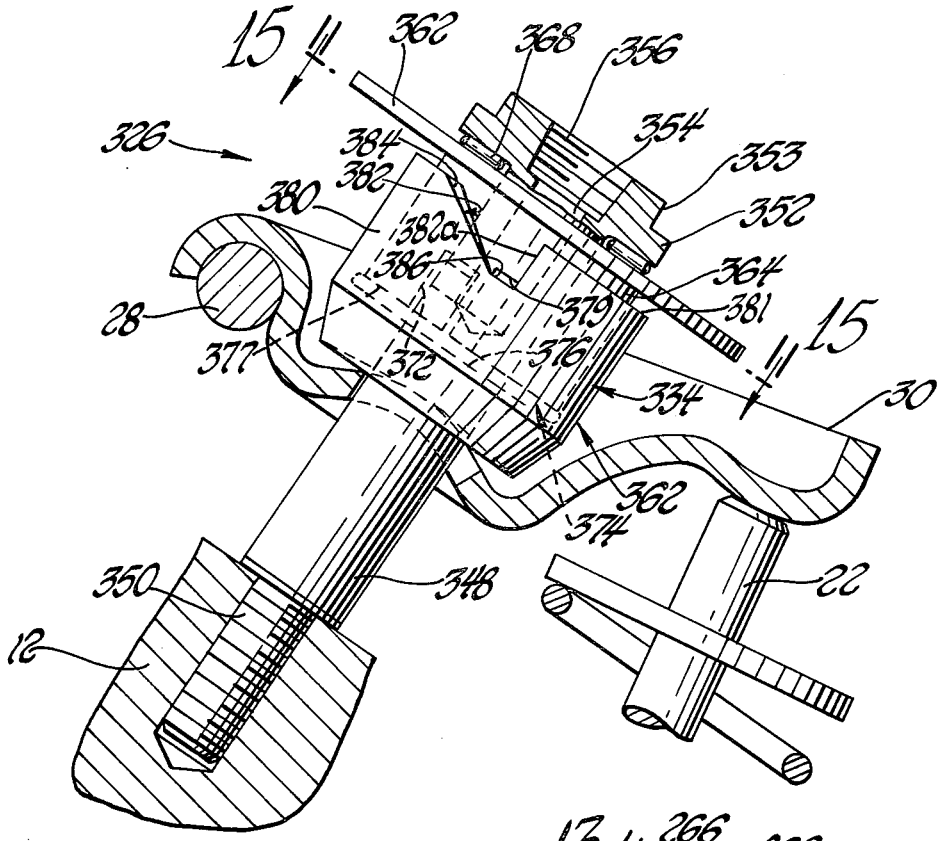
FIG. 14 is a view similar to FIG. 3 showing a modified form of the mechanism of FIG. 3.
Figure 15:
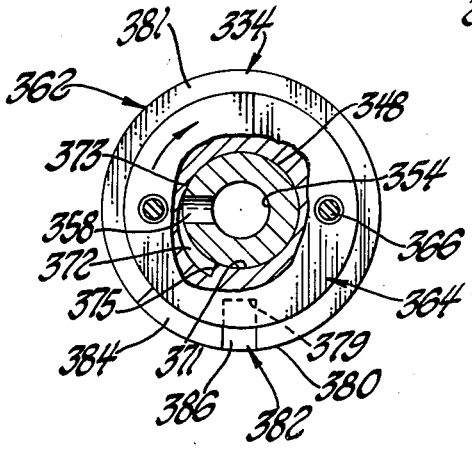
FIG. 15 is a sectional view taken along lines 15—15 of FIG. 14.

FIGS. 14 and 15 illustrate another version, essentially a modified version of the embodiment of FIGS. 2 through 8, wherein the extended length of the actuator can be varied in accordance with the angular position of the piston and cylinder members of the actuator with respect to each other. In FIG. 14, the engine valve operating mechanism is indicated collectively by reference numeral 326. The mechanism 326 includes an actuator support member 348 having a threaded shank or stud portion 358 at its inner, lower end which is mounted in a threaded boss on the cylinder head so that the actuator support member 348 projects from the cylinder head 12 between the valve operator support rod 28 and the stem 22 of the poppet valve 20. The outer end of the actuator support member 348 is formed with a flange 352 having flat surfaces 353 for engagement by two as is the case with the support member 48 of FIG. 3. A fluid supply passage 354 is formed in the support member 348, and communicates with a tapped hole 356 at the outer end for engagement with a fluid connector of the type shown in FIG. 2. A cross-port 358 is formed in the wall of the actuator support member 348 and communicates with the supply passage 354 (FIG. 15).

The mechanism 326 includes a fluid actuator designated collectively by 334 having first and second members 362 and 364, respectively, which are telescopically engaged with each other. In the illustrated embodiment, the first member 362 is a cylinder member which is seated against the engine valve operator 30. The cylinder member 362 is axially movable along the length of the actuator support member 348. The second member 64 is in the form of a piston received in the cylinder member 62. The piston member 64 is rotatable about the axis of the actuator support member 348 but is secured against axial movement along the length of the actuator support member 348.

As is the case with the embodiment of FIGS. 2–8, the piston member 364 is secured to a control member 362 by pins 366 such that rotation of the control member 362 about the longitudinal axis of the actuator support member 348 causes corresponding rotation of the piston member 364. Anti-friction bearings 368 are interposed between the outer surface of the control member 362 and the lower surface of the flange 352. As in the embodiment of FIGS. 2–8, a snap ring (not shown) may be mounted in a groove in the actuator support member 348 to support the piston member 64 against axial movement along the actuator support member 348.

The cylinder member 362 has an end wall 376 with a cylindrical side wall 380 projecting therefrom. The piston member 364 is slidably and rotatably received in the cylindrical side wall 380. The inner end 377 of the piston member 364 is disposed in opposed relationship to the end wall 376 to define an expansible and contractable fluid chamber 374 between the piston and cylinder members.

The piston member 364 has an inner cylindrical surface 371 in sliding contact with the outer surface of the actuator support member 348. A supply port 372 is formed in the inner cylindrical surface 371 of the piston member and has an open end at the inner end 377 of the piston member that communicates with the fluid chamber 374. In the supply position of the piston and cylinder members 364 and 362, the supply port 372 communicates with the cross-port 358 to permit fluid to flow from the supply passage 354 into the fluid chamber 374.

The cylindrical side wall 380 of the cylinder member 362 has a free edge 381 at its end remote from the end wall 376. An exhaust port is formed in the cylindrical side wall 380 which is in the form of an open-sided groove extending from the free edge 381 toward the end wall 376 to a bottom edge 386. A vent port 379 is formed in the piston member 364 and has an inlet end at the inner end 377 of the piston member that communicates with the fluid chamber 374, and an outlet end that is uncovered by the bottom edge 386 of the exhaust port in the exhaust position of the members as indicated in FIG. 14. The top edge of the vent port 379 in FIG. 14 is parallel to the bottom edge 386 of the exhaust port and is spaced above the bottom edge 386 so that any fluid in chamber 374 escapes through the vent port 379 over the bottom edge 386.

The exhaust port 382 has a control side edge 384 with its outer end at the free edge 381 of the side wall 380, and an inner edge at the bottom edge 386. The inner edge is spaced from the outer end along the circumference of the cylindrical side wall; the control side edge 384 makes an acute angle with the plane of the free edge 381 of the cylindrical side wall 380. The bottom edge 386 of the exhaust port 382 is straight and parallel to the plane of the free edge 381, and a second side edge 382*a* extends from the other end of the bottom edge 386 to the free edge 381. The side edge 382*a* is parallel to the longitudinal axis of the actuator support member 348.

The supply port 372 has a leading end 373 and a trailing end 375 (FIG. 15) which are in spaced parallel relationship to each other and are parallel to the longitudinal axis of the actuator support member. The depth of the supply port in the radial direction from the axis of the actuator support member increases from the leading end 373 to the trailing end 375 as shown in FIG. 15. Consequently, the rate of flow of fluid into the supply port 372 from the cross-port 358 increases as the piston member is rotated in a clockwise direction such that the leading end 373 sweeps past the cross-port 358.

In the exhaust position illustrated in FIG. 15, fluid flows into the supply port 372 at a low rate, and the vent port 379 is aligned with the bottom edge 386 of the exhaust port 382 so that fluid from chamber 374 escapes through the vent port. Consequently, the actuator 334 cannot extend from the retracted position. By rotating the piston member 364 in a clockwise direction, the rate of flow of fluid into the supply port 372 increases with the clockwise movement, and the vent port 379 moves to a position offset from the bottom edge 386 so that the flow of fluid from chamber 374 is blocked. Consequently, the fluid chamber 374 expands until the vent port 379 is uncovered by the control edge 384 of the exhaust port 382. The amount of extension of the actuator 334 is thus determined by the amount of clockwise movement of the piston member 364 from the exhaust position shown in FIG. 15. The rate of flow into the chamber 374 increases in proportion to the amount of clockwise movement of the piston member 364 from the position shown in FIG. 15 to thereby increase the rate of expansion of chamber 374, and hence the rate of extension of the actuator 334. The actuator extends until the edge 384 of the exhaust port or groove 382 clears the upper end of the vent port 379 to permit the escape of fluid and prevent further expansion of the chamber 374.

Figure 16:
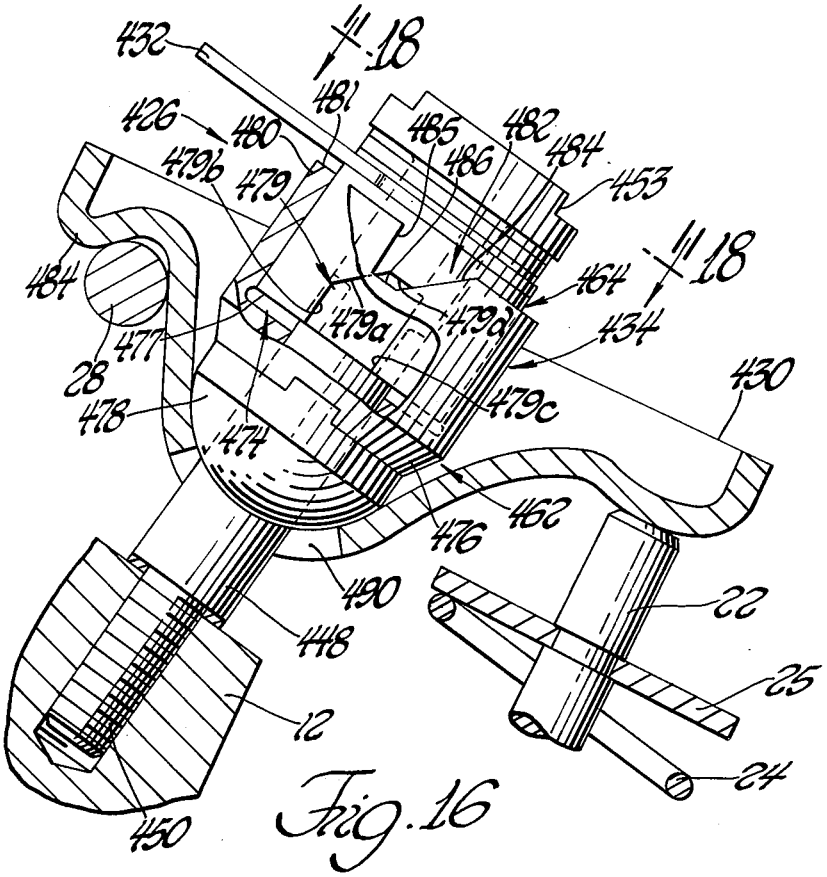
FIG. 16 is a view similar to FIG. 14 showing a modified form of the mechanism of FIG. 14.
Figure 18:
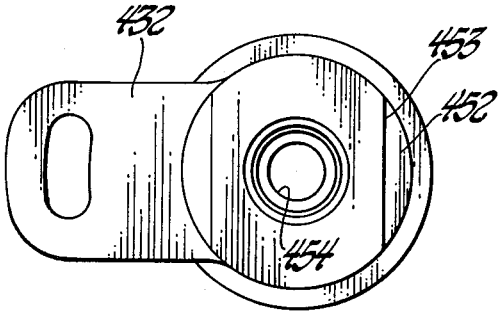
FIG. 18 is a top plan view of the mechanism of FIG. 16 as viewed along lines 18—18 of FIG. 16.
Figure 19:
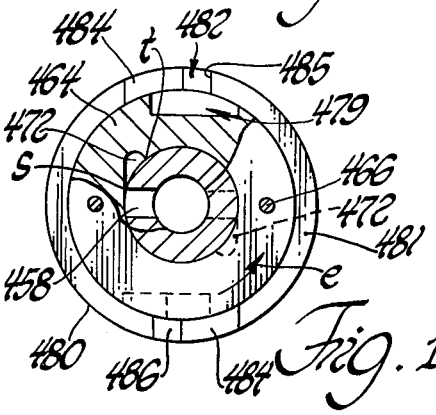
FIG. 19 is a sectional view taken along lines 19—19 of FIG. 17.
Figure 17:
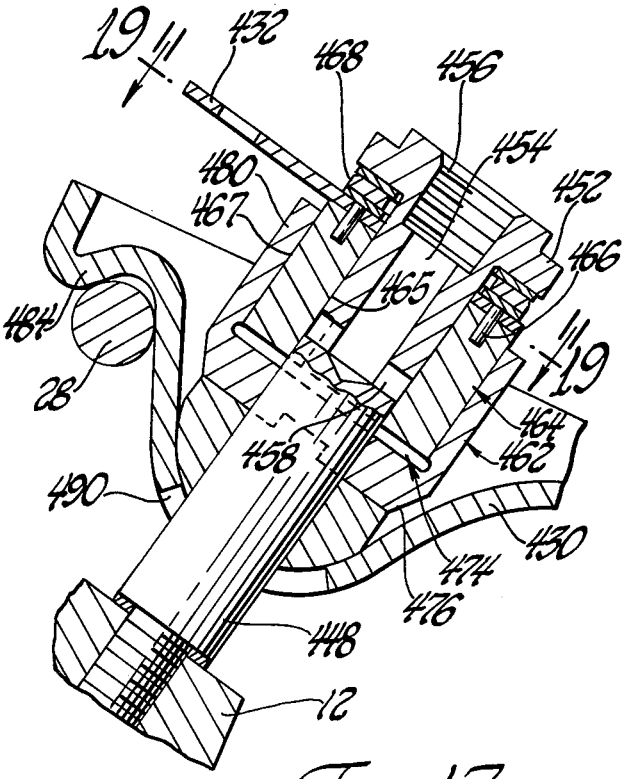
FIG. 17 is a cross-sectional view of the mechanism of FIG. 16.

FIGS. 16 through 19 illustrate another version of the invention that operates in a manner similar to that of the embodiment of FIGS. 14 and 15. The engine valve operating mechanism illustrated in FIGS. 16 through 19 is collectively designated by reference numbers 426 and includes an actuator support member 448. A threaded stud portion 450 is formed on the lower end of the actuator support member 448 and is mounted in a threaded boss on the cylinder head so that the support member 448 projects from the cylinder head between the valve operator support rod 28 and the stem 22 of the poppet valve 20. The outer end of the actuator support member 448 is formed with a flange 452 having flat, tool engaging surfaces 453 as in the embodiment of FIG. 5. A fluid supply passage 454 is formed in the support member 448, and communicates with a tapped hole 456 at the outer end for engagement with fluid connector 57 shown in FIG. 2. Cross-ports 458 in the wall of the actuator support member 448 communicate with the supply passage 454 (FIGS. 17 and 19).

The valve operating mechanism 426 includes a fluid actuator 434 having first and second members 462 and 464, respectively, which are telescopically engaged with each other. The first member 462 is in the form of a cylinder and is seated against an engine valve operator 430. The cylinder member 462 is axially movable along the length of the support member 448. The second member 464 is also in the form of a piston received in the cylinder member 462. The piston member 464 is rotatable about the axis of the actuator support member 448 but is restrained against axial movement in the same manner as the piston member 64 of FIG. 5, for example. The piston member 464 is secured to a control member 432 by pins 466 such that rotation of the control member 432 about the longitudinal axis of the support member 448 causes corresponding rotation of the piston member 464. An anti-friction bearing assembly 468 is interposed between the outer surface of the control member 432 and the lower surface of the flange 452 (FIG. 17).

The valve operating member is indicated by reference numeral 430 and has a hinge portion 484 supported on the valve operator support member 28. The valve operator 430 is dished downwardly as viewed in the drawings and has an opening 490 for receiving the support member 448.

The cylinder member 462 has an end wall 476 with a cylindrical side wall 480 projecting therefrom to a free end 481. The end wall 476 is seated on a semispherical bearing 478 and is connected therewith by slot and groove connection to prevent rotation between the bearing 478 and cylinder member 462. The frictional contact between the surfaces of the bearing member 478 and the upper concave surface of the valve operating member 430 prevent rotation between the bearing member and the support member 448.

Piston member 464 has an inner end 477 which is disposed in opposed relationship with the inner surface of the end wall 476 to define an expansible and contractable fluid chamber 474 between the piston and cylinder members. The piston member is thus slidably and rotatably engaged with the cylindrical side wall 480 of the cylinder member 462. Consequently, expansion of the chamber 474 causes the cylinder member and bearing member 478 to slide downwardly along the length of the actuator support member 448 to cause the valve operator 430 to depress the poppet valve spring 24 and move the poppet valve stem 22 in the valve opening direction. When fluid is permitted to exhaust from the chamber 474, the poppet valve spring 24, acting through the valve operator 430, causes the actuator 426 to retract to the position shown in FIG. 16.

The piston member 464 has an inner cylindrical surface 465 extending between the end walls thereof that is in sliding contact with the outer surface of the support member 448, and an outer cylindrical surface 467 (FIG. 17) that is in sliding contact with the inner surface of the cylindrical wall 480. Supply ports 472 are formed in the inner cylindrical surface 465 of the piston member 464 (FIG. 19) on diametrically opposite sides of the longitudinal axis of the support member 448. The supply ports 472 have an open end at the inner end 477 of the piston member that is in communication with the fluid chamber 474. The supply ports 472 communicate with the cross-ports 458 in the supply position of the piston and cylinder members.

Diametrically opposed exhaust ports 482 are formed in the cylindrical wall 480 of the cylinder member as shown in FIGS. 16 and 19. Each exhaust port 482 is in the form of an open-sided groove extending from the free edge 481 toward the end wall 476 of the cylinder member to a bottom wall 486 of the groove. The bottom edge 486 of the exhaust port 482 is straight and parallel to the plane of the free edge 481. The exhaust port 482 has a control side edge 484 having an outer end at the free edge 481 and an inner end at the bottom edge 486 which is spaced from the outer end along the circumference of the side wall 480. A second side edge 485 extends from the other end of the bottom edge 486 to the free edge 481. The side edge 485 is parallel to the longitudinal axis of the actuator support member 448. As viewed in FIG. 16, the control side edge 484 makes an acute angle with respect to the plane of the free edge 481; it is inclined upwardly and outwardly from its inner end to its outer end, i.e. in a direction away from the side edge 485.

A pair of diametrically opposed vent ports 479 are formed in the outer surface of the piston member 464. Each of the vent ports 479 has an inlet end at the inner end 477 of the piston member that communicates with the fluid chamber 474, and an outlet end that is uncovered by the bottom edge 486 of the exhaust port in the exhaust position of the piston and cylinder members illustrated in FIG. 16. Thus, in the exhaust position illustrated in FIG. 16, fluid in chamber 474 can escape to the vent port 479 over the bottom edge 486 of the exhaust port 482.

The vent port 479 has a top edge **479*d* that is parallel to the bottom edge 486 of the exhaust port and is spaced above the bottom edge of the exhaust port in the exhaust position shown in FIG. 16. The vent port 479 also includes a pair of said edges 479*b* and 479*c* extending from opposite ends of the top edge 479*b*, with the side edge 479*b* including an inclined portion 479*a* that extends from the top edge 479*d* at an acute angle with respect thereto. The inclined portion 479*a* in the illustrated embodiment is parallel to the control side edge 484 of the exhaust port 482**.

With reference to FIG. 19, each supply port 472 has a leading end s and a trailing end t that extend along the length of the supply port in parallel relationship to the axis of the support member 448 and are thus in spaced parallel relationship to each other. The depth of the supply port 472 in the radial direction from the axis of the actuator support member 448 increases from the leading ends to the trialing end t such that the rate of flow into the supply port from the cross-port 458 increases as the piston member 464 is rotated in a counterclockwise direction from the position shown in FIG. 19, the direction indicated by arrow e.

The piston member 464 serves as a control valve as in the previously described embodiment. In the exhaust position illustrated in FIG. 19, the supply port 472 is out of communication with the crossports 458. The upper end of the vent port 479 is uncovered by the bottom wall 486 of the exhaust port 482 as shown in FIG. 16. To move the parts into a supply position, the control valve or piston 464 is rotated in a counterclockwise direction as viewed in FIG. 19 to move the vent port 479 to the right (as viewed in FIG. 16) to offset it from the bottom wall of the exhaust port.

Movement of the control valve member 464 to a supply position offsets the vent port 479 from the bottom wall 486 of the exhaust port and brings the supply ports 472 into communication with the cross-ports 458 to cause fluid to be admitted to chamber 474. The resulting expansion of chamber 474 causes extension of the fluid actuator 434. As a result, the cylinder member moves downwardly as viewed in FIG. 16 along the actuator support member 448 to cause clockwise pivoting movement of the valve operator 430 in a poppet valve opening direction. The amount of extension is determined by the position of the vent port 479 relative to the control side wall 484 of the exhaust port 482, which in turn is dependent upon the angular position of the piston and cylinder member with respect to each other about the longitudinal axis of the support member 448. The cylinder member moves downwardly until the vent port 479 is cleared by the control side edge 484 to relieve the pressure in the fluid chamber 474 by permitting fluid to escape through the vent port over the side edge 484.

The configuration of the supply port 472, and its relationship to the vent port and exhaust port is such that if maximum extension of the actuator 434 is desired, the control valve member 464 will be rotated to a position to permit maximum flow into the supply ports 472 from the cross-ports 458 which in turn will place the vent port 479 in the furthest offset position offset position with respect to the bottom wall 486 so that it cannot be uncovered until the cylinder member 476 is moved downwardly sufficiently that the portion of the side edge 484 nearer its upper end at the free end 481 will clear the vent port.

Thus, in the embodiments of FIGS. 14–15 and 16–19, the rate of extension of the actuator is also variable in accordance with the angular position of the cylinder and piston members with respect to each other due to the configuration of the supply ports 372 and 472. If a large amount of extension is required, fluid is admitted at a faster rate so that the fluid chamber 374 and 474 expand faster, and so that the actuator extends to its maximum length determined by the angular position of the piston and cylinder members relative to each other at a faster rate. Stated another way, the time of a cycle of extension and retraction of the actuator 434 does not vary directly with the length of the stroke. As the desired stroke length increases, the rate of fluid input to the fluid chamber 474 increases to cause faster expansion of the chamber, and hence faster extension of the actuator. Because of the configuration of the supply ports 372 and 472, the time difference is minimized when the stroke is varied.

FIGS. 20–22 illustrate another embodiment of the invention wherein the fluid actuator is supported by an overhead actuator support member extending transversely of the longitudinal axis of the actuator. In the embodiment of FIGS. 20–23, the necessity of a coaxial actuator support member such as, for example, the actuator support member 48 of FIGS. 2 and 3, is eliminated. The horizontal, overhead actuator support member is rotatably supported in support brackets spaced from each other along the length of the cylinder head.

With reference to FIG. 20, the cylinder head is indicated by reference numeral 12'. The cylinder head 12' differs slightly from the cylinder head 12 of the previous embodiments in that the boss for supporting the threaded shank or stud portion of the coaxial actuator support members, such as the support member 48 of FIGS. 2 and 3, is not required. As in FIG. 2, the cylinder 12' has a cover 13, and overlies a bank of cylinders, one cylinder 14 being partially illustrated in FIG. 20. The spark plug 16 is also illustrated in FIG. 2 for igniting the fuel in the cylinder 14. An intake or exhaust port 18 is illustrated in FIG. 20 which is controlled by a poppet valve 20 having a stem 22 slidably mounted in the cylinder head 12'. The poppet valve 20, as in the previously described embodiments, is biased to a closed position by a spring 24 having one end seated on the cylinder head and its other end seated against a spring seat washer secured to the outer end of the poppet valve stem 22. Reference numeral 526 collectively designates engine valve operating mechanism including an actuator support member indicated by reference numeral 548. The actuator support member 548 is rotatably mounted in the upright walls 551 of spaced support brackets 550. One such support bracket 550 is illustrated in FIGS. 20–22 and has a base 553 secured in a conventional manner to the cylinder head 12'. Also mounted in the support brackets 550 is a valve operator support rod 528. A valve operator 530 for each poppet valve 20 has a hinge portion at one end **530*a* that is pivotally supported on the valve operator support rod 528. The other end 530*b* of the valve operator 530 is seated against the outer end of the poppet valve stem 22**.

The valve operating mechanism 526 includes an extendable and retractable fluid actuator 534 having a control member 532. The fluid actuator 534 is shown in its contracted condition in FIG. 20, and the poppet valve spring 24 maintains the poppet valve 20 in its closed position when the fluid actuator 534 is in its contracted condition. When the fluid actuator 534 extends from the position shown in FIG. 20, it causes the valve operator 530 to pivot in a clockwise direction, or in a poppet valve opening direction, to compress spring 24 and open the poppet valve 20 relative to the port 18.

The actuator support member 548 also serves as a fluid conduit for connection with the main supply conduit 38 (FIG. 1) so that fluid pressure is constantly available for each of the fluid actuators 534 supported on the support member 548. The control member 532 is rotatable about the longitudinal axis of the fluid actuator 534 (which axis is indicated at 532*a* in FIG. 20) between supply and exhaust positions to respectively cause the actuator to extend and retract as is discussed in greater detail below. When the fluid actuator 534 is placed in a supply position by the control member 532, it is caused to extend and move the valve operator 530 in a valve opening direction. When the fluid actuator 534 is actuated by rotation of the control member 532 to an exhaust position, it is permitted to retract in a valve closing direction, and the poppet valve spring 24 causes the valve operator 530 to move in a counterclockwise direction as viewed in FIG. 20 and contract the fluid actuator 534.

The fluid actuator 534 includes first and second members 562 and 564, respectively, which are telescopically engaged with each other. In FIGS. 20–22, the first member 562 is in the form of a cylinder and is seated against the engine valve operator 530. The cylinder member 562 is axially movable along the axis 532*a*, transverse to the actuator support member 548, which results in movement of the valve operator 530 in poppet valve opening and poppet valve closing directions.

The second member 564 is in the form of a piston received in the cylinder 562. The piston member 564 is rotatable about the axis 532*a* and with respect to the actuator support member 548, but is otherwise restrained against movement with respect to the actuator support member 548. The piston member 564 has a rod 564*a* projecting from its upper end as viewed in the drawings, and the control member 532 is clamped to the piston rod 564*a* such that rotation of the control member 532 about the axis 532*a* causes corresponding rotation of the piston member 564.

As shown in the drawings, the piston member 564 is rotatably received in a cylindrical bore 564*b* formed transversely in the actuator support member 548. The upper end of the bore 564*b* receives the piston rod 564*a*. The shoulder 564*c* at the reduced end portion of the bore cooperates with the control member 532 to prevent movement of the piston member 564 transversely with respect to the axis of the actuator support member 548.

A supply passage 554 is formed in the actuator support member 548. The piston member 564 is formed with an axial supply port 572. The supply port 572 communicates with the supply passage 554 through cross-ports 558 formed in the piston member 564 (FIGS. 21 and 22). The cross-ports 558 each have enlarged inlet ends 558*a* as shown in FIG. 21.

The cylinder member 562 has an end wall 576 with a cylindrical side wall 580 projecting therefrom. The cylindrical side wall 580 slideably and rotatably receives the piston member 564. The piston member 564 has an inner end 577 disposed in opposed relationship to the inner surface of the end wall 576 to define an expansible and contractable fluid chamber 574 between the cylinder and piston members. The cylindrical side wall 580 projects from the end wall 576 to a free end 581. The lower surface of the end wall 576 is convex, and is formed with a slot 576*a* that is engaged with a rib 578 projecting upwardly from the valve operator 530 and extending substantially along its entire length as illustrated in FIG. 21. Thus, the rib and slot connection between the valve operator 530 and cylinder member 562 prevents rotation of the cylinder member 562 with respect to the valve operator.

Diametrically opposed exhaust ports 582 are formed in the cylindrical wall 580 of the cylinder member as shown in FIGS. 20 and 22. Each exhaust port 582 is in the form of an open-sided groove extending from the free edge 581 toward the end wall 576 of the cylinder member to a bottom wall 586 of the groove. The bottom wall 586 of the exhaust port 582 is straight and parallel to the plane of the free edge 581 of the cylinder member. The exhaust port 582 (FIG. 20*a*) has a control side edge 584 having an outer end at the free edge 581 and an inner end at the bottom edge 586 which is spaced from the outer end along the circumference of the side wall 580. The control side edge 584 has a stepped portion 584*a* located between, and parallel to the free edge 581 and bottom edge 586. A second side edge 585 extends from the other end of the bottom edge 586 to the free edge 581. In the illustrated embodiment, the side edge 585 is parallel to the longitudinal axis 532*a* of the actuator 534.

A pair of diametrically opposed vent ports 579 are formed in the outer surface of the piston member 564. Each of the vent ports 579 has an inlet end at the inner end 577 of the piston member that communicates with the fluid chamber 574, and an outlet end that is uncovered by the bottom edge 586 of the exhaust port in the exhaust position of the piston and cylinder members illustrated in FIGS. 20–22. In the exhaust position, fluid in chamber 575 can escape through the vent port 579 over the bottom edge 586 of the exhaust port 582.

The vent port 579 has a top edge 579*a* (FIG. 20*a*) that is parallel to the bottom edge 586 of the exhaust port and is spaced above the bottom edge of the exhaust port in the exhaust position shown in the drawings. The vent port 579 also includes a pair of spaced, parallel side edges extending from opposite ends of the top edge 579*a* to the inner end 577 of the piston member 564.

Figure 20A:
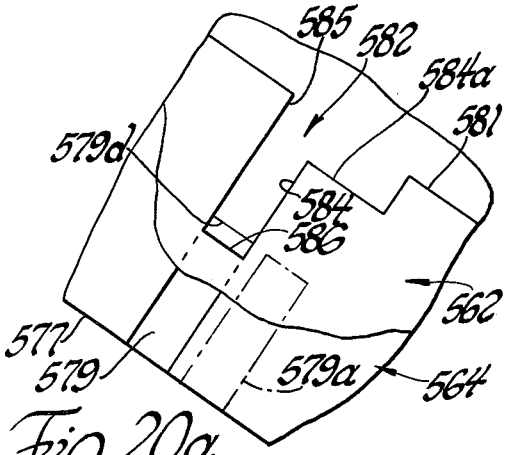

With reference to FIGS. 21 and 22, there is a constant supply of fluid to the chamber 574 from the supply passage 554 through the cross ports 558 and supply port 572. In the exhaust position shown in FIGS. 21 and 22, the fluid escapes from chambers 574 through the vent ports 579 over the bottom edge 586 of the exhaust port 582. The upper end of the vent port 579 is uncovered by the bottom wall 586 of the exhaust port 582 in the exhaust position as shown in FIG. 20*a*. To move the ports to a supply position, the control valve or piston 564 is rotated by the control member 532 about the axis 532*a* to move the vent port 479 to the rights as viewed in FIG. 20*a* to offset it from the bottom wall 586 of the exhaust port.

Movement of the control valve member 564 to a supply position offsets the vent port 579 from the bottom wall 586 so that the vent port is closed by the inner surface of the cylindrical wall 580 beneath the step 584*a*. Since fluid can no longer escape from the chamber 574, the chamber expands to cause extension of the fluid actuator 534. As a result, the cylinder member 562 moves downwardly, along the axis 532*a*, away from the horizontal actuator support member 548 to cause clockwise pivoting movement of the valve operator 530 in a poppet valve opening direction. If the vent port 579 is moved to approximately the phantom line position illustrated in 579*a* in FIG. 20*a*, the actuator 534 will extend until the top edge 579*d* of the vent port clears the step 584*a* of the exhaust port to permit fluid to escape from chamber 574 and stop further extension of the actuator. When the piston member 564 is returned to the position such that the vent port is aligned with the bottom wall 586, the valve spring 24 will cause the valve operator 532 to pivot counterclockwise and cause the chamber 574 to contract and the cylinder member 562 to return to the position shown in FIGS. 20–22 relative to the piston 564.

The actuator support member 548 can be rotated about its longitudinal axis 548*a* (FIG. 22) to in turn adjust the position of the actuator along the length of the valve operator 530. The actuator 534 swings about the axis 548*a* between the phantom line position illustrated approximately at 534A and 534B in FIG. 21 in response to rotation of the actuator support member 548.

When the actuator is in position 534A, extension of the actuator to a length such that the vent ports 579 are uncovered by the step 584*a* of the exhaust port 582 causes a greater amount of movement of the valve 20 away from its port 18 than when the actuator is in position 534B of FIG. 21. Thus, the amount of opening movement of the valve 20 is determined both by the amount of extension of the fluid actuator 534 from its contracted condition, and by the position of the fluid actuator along the length of the valve operator 530. In the embodiment of FIGS. 20–22, the valve operator 530 is arcuate with its center of curvature on the longitudinal axis 548*a* of the actuator support member 548. The valve operator 530 transmits a greater or lesser amount of motion to the poppet valve 20 in the valve opening direction upon extension of the actuator valve 34 depending upon the position of the actuator 534 with respect to the valve operator support 528. As the distance between the axis 532*a* of the actuator from the valve operator support 528 increases, the amount of motion transmitted to the poppet valve by the valve operator decreases.

In the FIGS. 20–22 embodiment, oscillation of the control member 532 about the axis 532*a* in turn causes corresponding oscillation of the piston member 564 to cause expansion and contraction of the fluid actuator 534. The amount of movement transmitted to the poppet valve by the valve operator 530 is varied depending upon the position of the actuator along the length of the valve operator 530, as determined by its angular position about the axis 548*a*.

FIG. 23 discloses a modification of the embodiment of FIGS. 20–22 wherein the actuator support member is adjusted by rectilinear movement to change the position of the fluid actuator along the length of the valve operator.

In FIG. 23, the valve operating mechanism is indicated collectively by reference numeral 626 and includes an actuator support member indicated by reference numeral 648. The actuator support member 648 is slidably mounted on spaced support brackets 650, one such support bracket 650 being illustrated in FIG. 23. A valve operator support rod 628 is also mounted in the support brackets 650. A valve operator 630 for each poppet valve has a hinged portion at one end 630*a* that is pivotally supported on the valve operator support rod 628. The other end 630*b* of the valve operator 630 is seated against the outer end of the poppet valve stem 22.

The valve operating mechanism 626 includes an extendable and retractable fluid actuator 634 having a control member 632. The fluid actuator 634 is shown in its contracted condition. As in the previously described embodiments, the poppet valve spring 24 maintains the poppet valve 20 in its closed position when the fluid actuator 634 is in its contracted condition. When the fluid actuator 634 extends from the position shown in FIG. 23, it causes the valve operator 630 to pivot in a clockwise direction, or in a poppet valve opening direction, to compress spring 24 and open the poppet valve 20 relative to its port 18.

A fluid supply passage 654 is formed in the actuator support member 648 for connection with the main supply conduit 38 (FIG. 1) so that fluid pressure is constantly available for the fluid actuator 634. The control member 632 is rotatable about the longitudinal axis 632*a* of the fluid actuator 634 between supply and exhaust positions to respectively cause the actuator to extend and retract. When the fluid actuator 634 is placed in a supply position by control member 632, it is caused to extend and move the valve operator 630 in a valve opening direction. When the fluid actuator 634 is actuated by rotation of the control member 632 to an exhaust position, it is permitted to retract in a valve closing direction, and the poppet valve spring 24 cause the valve operator 530 to return to the FIG. 23 position and contract the actuator 634.

The fluid actuator 634 includes first and second members 662 and 664, respectively, which are telescopically engaged with each other. The actuator 634 in the illustrated embodiment of FIG. 23 is substantially identical to the actuator 534 of the embodiment of FIGS. 20–22. The first member 662 is in the form of a cylinder and is seated against the engine valve operators 630. The cylinder member 662 is axially movable along the axis 532*a*, toward and away from the actuator support member 648, which results in movement of the valve operator 630 in poppet valve opening and poppet valve closing directions.

The second member 664 is also in the form of a piston received in the cylinder 662 as in the case of the previously described embodiment of FIGS. 20–22. The piston member 664 is rotatable about the axis 632*a* and with respect to the support member 648, but is otherwise restrained against movement with respect to the actuator support member 648 in a manner similar to that shown in the previously described embodiment.

The actuator support member 648 also serves as a fluid conduit for connection with the main supply conduit 38 (FIG. 1) so that fluid pressure is constantly available for each of the fluid actuators 634 supported on the support member 548. The control member 632 is rotatable about the longitudinal axis of the fluid actuator 634 (which axis is indicated at 632*a* in FIG. 23) between supply and exhaust positions to respectively cause the actuator to extend and retract as is discussed in greater detail below. When the fluid actuator 634 is placed in a supply position by the control member 632, it is caused to extend and move the valve operator 630 in a valve opening direction. When the fluid actuator 634 is actuated by rotation of the control member 632 to an exhaust position, it is permitted to retract in a valve closing direction, and the poppet valve spring 24 causes the valve operator 630 to move in a counterclockwise direction as viewed in FIG. 20 and contract the fluid actuator 634.

The fluid actuator 634 includes first and second members 662 and 664, respectively, which are telescopically engaged with each other. The first member 662 is in the form of a cylinder and is seated against the engine valve operator 630. The cylinder member 662 is axially movable along the axis 632*a*, transverse to the actuator support member 648, which results in movement of the valve operator 630 in poppet valve opening and poppet valve closing directions.

The second member 664 is in the form of a piston received in the cylinder 662. The piston member 664 is rotatable about the axis 632*a* and with respect to the actuator support member 648, but is otherwise restrained against movement with respect to the actuator support member 648. The piston member 664 has a rod 664*a* projecting from its upper end as viewed in the drawings, and the control member 632 is clamped to the piston rod 664*a* such that rotation of the control member 632 about the axis 632*a* causes corresponding rotation of the piston member 664.

As shown in the drawings, the piston member 664 is rotatably received in a cylindrical bore 664*b* formed transversely in the actuator support member 648. The upper end of the bore 664*b* receives the piston rod 664*a*. The shoulder 664*c* at the reduced end portion of the bore cooperates with the control member 632 to prevent movement of the piston member 664 in the direction of axis 632*a*.

A supply passage 654 is formed in the actuator support member 648. The piston member 664 is formed with an axial supply port 672. The supply port 672 communicates with the supply passage 654 through cross-ports 658 formed in the piston member 664. The cross-ports 658 each have enlarged inlet ends 658*a*.

The cylinder member 662 has an end wall 676 with a cylindrical side wall 680 projecting therefrom. The cylindrical side wall 680 slidably and rotatably receives the piston member 664. The piston member 664 has an inner end 677 disposed in opposed relationship to the inner surface of the end wall 676 to define an expansible and contractable fluid chamber 674 between the cylinder and piston members. The cylindrical side wall 680 projects from the end wall 676 to a free end 681. The lower surface of the end wall 676 is convex, and is formed with a slot 676*a* that is engaged with a rib 678 projecting upwardly from the valve operator 630 and extending substantially along its entire length. Thus, the rib and slot connection between the valve operator 630 and cylinder member 662 prevents rotation of the cylinder member 662 with respect to the valve operator.

Diametrically opposed exhaust ports 682 are formed in the cylindrical wall 680 of the cylinder member. The illustrated exhaust port 682 is of the same configuration as the exhaust ports 582, and is in the form of an open-sided groove extending from the free edge 681 toward the end wall 676 of the cylinder member to a bottom wall 686 of the groove.

A pair of diametrically opposed vent ports 679 are formed in the outer surface of the piston member 664. The vent ports 679 in FIG. 23 are of the same configuration as the vent ports 579 of FIGS. 20–22, and have the same relationship to the exhaust port 682 as the vent ports 579 have to exhaust ports 582.

There is a constant supply of fluid to the chamber 674 from the supply passage 654 through the cross ports 658 and supply port 672. In the exhaust position shown in FIG. 23, the fluid escapes from chambers 674 through the vent ports 679 over the bottom edge of the exhaust port 682. The upper end of the vent port 679 is uncovered by the bottom wall 686 of the exhaust port 682 in the exhaust position as shown in FIG. 23. To move the ports to a supply position, the control valve or piston 664 is rotated by the control member 632 about the axis 632*a* to offset the vent port 679 from the bottom wall 686 of the exhaust port as in the previously described embodiment.

Movement of the control valve member 664 to a supply position offsets the vent port 679 from the bottom wall 686 so that the vent port is closed by the innser surface of the cylindrical wall 680, and the chamber 674 expands to cause extension of the fluid actuator 634. As a result, the cylinder member 662 moves downwardly, along the axis 632*a*, away from the horizontal actuator support member 648 to cause clockwise pivoting movement of the valve operator 630 in a poppet valve opening direction. When the piston member 664 is returned to the position such that the vent port is aligned with the bottom wall 686, the valve spring 24 will cause the valve operator 632 to pivot counterclockwise and cause the chamber 674 to contract and the cylinder member 662 to return to the position shown in FIG. 23 relative to the piston 664.

The actuator support member 648 can be in the direction of arrow 700 to in turn adjust the position of the actuator along the length of the valve operator 630. The support member 648 is formed with a slot 702 that receives a bolt 704 to slidably connect support member 648 to bracket 626. A washer 706 is illustrated to prevent separation of the support member 648 from the bracket.

The actuator support member 648 can be adjusted along the slot 702 to in turn adjust the position of the actuator along the length of the valve operator 630.

The hydraulic system illustrated in FIG. 1 is adaptable to each of the valve operating mechanism embodiments of FIGS. 2–23. As shown in FIG. 1, a valve 45*a* controls the flow between the pump 44 and accumulator 45. During normal operation of the vehicle, valve 45*a* permits flow only in the direction from the pump to the accumulator, or in the direction of arrow e. The pump 44 supplies hydraulic fluid to the accumulator until the pressure in the accumulator is sufficient to prevent flow in the direction of arrow e past valve 45*a*.

In the illustrated embodiment of FIG. 1, valve 45*a* is operatively connected through a solenoid, or the like, with the starter motor 45*b*. When the starter motor 45*b* is energized, valve 45*a* is actuated to permit flow from the accumulator into the conduit 38, in the direction opposite to arrow e. Therefore, the hydraulic system can be pressurized prior to ignition, and prior to the time that the engine drives the pump 44. Hence, the valve operating mechanisms can be programmed through the input members 46 of the FIG. 1 embodiment to either hold all of the poppet valves open until ignition occurs, or to operate in any predetermined sequence relative to crankshaft rotation while the starter motor 45*b* is energized prior to ignition. With any embodiment, the mechanims can be individually programmed so that the poppet valve will operate in any predetermined sequence as the engine is operated by the starter motor 45*b* prior to ignition.

While several specific forms of the invention are described in the foregoing specification and illustrated in the accompanying drawings, it should be understood that the invention is not limited to the exact construction shown. To the contrary, various alterations in the construction and arrangement of parts, all falling within the scope and spirit of the invention, will be apparent to those skilled in the art.

What is claimed is:

1. Engine valve operating mechanism for moving an engine poppet valve in opening and closing directions relative to the port controlled thereby, said mechanism comprising: an extendable and retractable fluid actuator; said actuator including first and second members telescopically engaged with each other; said first member having an end wall with a cylindrical side wall projecting therefrom, said second member being slidably and rotatably received in the cylindrical side wall of said first member and defining an expansible and contractable fluid chamber with said first member; said members being movable between extended and retracted positions with respect to each other in response to expansion and contraction, respectively, of said fluid chamber; and supply and exhaust ports in said members operable to control the flow of fluid into and out of said chamber in accordance with the angular position of said members with respect to each other; said members being rotatable with respect to each other between (1) a supply position in which said chamber is in fluid communication with said supply port and in which fluid communication between said chamber and said exhaust port is blocked at least in the contracted condition of said chamber to thereby cause said chamber to expand from the contracted condition when fluid flows into said chamber from said supply port, and (2) an exhaust position in which said fluid chamber is in fluid communication with said exhaust port to permit said chamber to contract from an expanded condition and to prevent said chamber from being expanded from the contracted condition.

2. Mechanism as claimed in claim 1 wherein said second member has inner and outer ends with said inner end disposed in opposed relationship to the inner surface of the end wall of said first member to define said fluid chamber between said first and second members.

3. Mechanism as claimed in claim 2 further including an actuator support member, and wherein said second member is mounted on said actuator support member such that said first member moves toward and away from said second member as said actuator retracts and extends, respectively.

4. Mechanism as claimed in claim 3 further including a valve operator support member spaced from said actuator support member, and a valve operator mounted on said valve operator support member in such a manner as to be movable with respect to said actuator support member.

5. Mechanism as claimed in claim 4 wherein said first member is engaged with said valve operator such that extension of said actuator causes said valve operator to move away from said second member, and retention of said actuator permits said valve operator to move toward said second member.

6. Mechanism as claimed in claim 5 wherein said actuator support member is coaxial with said actuator such that said first member slides along the length of said actuator as it moves toward and away from said second member in response to extension and retraction of said actuator.

7. Mechanism as claimed in claim 6 wherein said second member is rotatably mounted on said actuator support member but is otherwise secured against movement with respect to said actuator support member.

8. Mechanism as claimed in claim 7 wherein said first member is engaged with said valve operator in such a manner as to restrain said first member against rotation with respect to said actuator support member.

9. Mechanism as claimed in claim 8 wherein said supply and exhaust ports include at least one exhaust port formed in the cylindrical wall of said first member.

10. Mechanism as claimed in claim 9 wherein said supply and exhaust ports include at least one supply port formed in said second member.

11. Mechanism as claimed in claim 10 further including a supply passage in said actuator support member for connection with a source of fluid and a cross-port in the wall of said actuator support member communicating with said supply passage; and wherein said supply port communicates with said fluid chamber and cross-port in the supply position of said first and second members, and wherein said supply port communicates with said fluid chamber and said exhaust port in the exhaust position of said first and second members.

12. Mechanism as claimed in claim 11 wherein the end wall of said first member has a concave outer surface.

13. Mechanism as claimed in claim 12 wherein said valve operator has a dished central portion that engages said concave outer surface.

14. Mechanism as claimed in claim 13 wherein said valve operator is pivotally supported on said valve operator support member.

15. Mechanism as claimed in claim 6 wherein said second member is fixed to and non-movable with respect to said actuator support member.

16. Mechanism as claimed in claim 15 wherein said first member is rotatable with respect to said valve operator and with respect to said actuator support member.

17. Mechanism as claimed in claim 16 wherein said supply and exhaust ports include at least one exhaust port formed in the cylindrical wall of said first member.

18. Mechanism as claimed in claim 17 wherein said supply and exhaust ports include at least one supply port formed in said second member.

19. Mechanism as claimed in claim 18 further including a supply passage in said actuator support member for connection with a source of fluid, and wherein said supply port includes a trunk portion communicating at one end with said supply passage and at its other end with the outer surface of said second member and a branch portion connecting said trunk portion with said fluid chamber, and wherein said other end of said trunk portion is blocked by said first member in the supply position of said first and second members and communicates with said exhaust port in the exhaust position of said first and second members.

20. Mechanism as claimed in claim 19 further including a control member rotatably mounted on said actuator support member for rotating said first and second members with respect to each other between said supply and exhaust positions.

21. Mechanism as claimed in claim 20 further including connecting means connecting said control member and first member to cause said first member to rotate with said control member but permit said first member to slide along said actuator support member with respect to said control member.

22. Mechanism as claimed in claim 21 wherein said connecting means includes a pair of spaced, apertured lugs projecting outwardly from said first member, and a pair of pins on said control member each projecting into the aperture of one of said lugs.

23. Mechanism as claimed in claim 22 wherein said second member is formed integrally on said actuator support member.

24. Mechanism as claimed in claim 19 wherein said exhaust port has a side wall with upper and lower edges spaced from each other both in axial and circumferential directions on the side wall of said first member so that the extended length of said actuator is determined by the angular position of said first and second members with respect to each other.

25. Mechanism as claimed in claim 24 wherein said side wall of said exhaust port is stepped between the upper and lower edges thereof.

26. Mechanism as claimed in claim 8 further including a supply passage in said actuator support member for connection with a source of fluid, and a cross-port in the wall of said actuator support member communicating with said supply passage.

27. Mechanism as claimed in claim 26 wherein said second member has inner and outer cylindrical surfaces between the end walls thereof with said inner surfaces in sliding contact with said actuator support member, and wherein said supply and exhaust ports include a supply port formed in said inner cylindrical surface of said second member and having an open end at the inner end of said second member communicating with said fluid chamber, said supply port communicating with said cross-port in said supply position of said members.

28. Mechanism as claimed in claim 27 wherein said cylindrical side wall of said first member has a free edge spaced from the end wall thereof, and wherein said supply and exhaust ports include at least one exhaust port in the form of an open-sided groove extending from said free edge toward said end wall of said first member to a bottom edge.

29. Mechanism as claimed in claim 28 further including a vent port formed in said second member and having an inlet end at the inner end of said second member that communicates with said fluid chamber and an outlet end that communicates with the outer surface of said second member, the bottom edge of said exhaust port in said exhaust position of said members uncovering said outlet end of said vent port.

30. Mechanism as claimed in claim 29 wherein said exhaust port has a control side edge having an outer end at the free edge of said cylindrical side wall and an inner end at the bottom edge of said groove and spaced from said outer end along the circumference of said cylindrical side wall, said outlet end of said vent port being offset from the bottom edge of said exhaust port in the supply position of said members in the direction of the outer edge of said control side edge so that said outlet end will be uncovered by said control edge to limit the expansion of said chamber and hence the extended length of said actuator an amount determined by the angular position of said first and second member with respect to each other.

31. Mechanism as claimed in claim 30 wherein said control side edge is straight and makes an acute angle with the plane of the free edge of said cylindrical side wall.

32. Mechanism as claimed in claim 31 wherein said bottom edge of said exhaust port is straight and parallel to the plane of the free edge of said cylindrical side wall, said control side edge extending from one end of said bottom edge, and further including a second side edge for said exhaust port extending from the other end of said bottom edge to the free edge of said cylindrical side wall.

33. Mechanism as claimed in claim 32 wherein said vent port is formed in the outer surface of said second member and includes a top edge that is parallel to the bottom edge of said exhaust port and is spaced above said bottom edge of said exhaust port in the exhaust position of said member.

34. Mechanism as claimed in claim 33 wherein said vent port includes a pair of side edges extending from opposite ends of the top edge thereof to the inner end of said second member, one of said edges including an inclined portion extending from said top edge at an acute angle with respect to said top edge.

35. Mechanism as claimed in claim 34 wherein said last named inclined portion is parallel to said control side edge of said exhaust port.

36. Mechanism as claimed in claim 35 wherein said supply port has leading and trailing ends that are in spaced parallel relationship to each other and are parallel to the longitudinal axis of said actuator support member, and wherein the depth of said supply port in the radial direction from the axis of said actuator support member increases from said leading end to said trailing end such that the rate of flow of fluid into said supply port from said cross-port increases as the second member is rotated in a direction such that said leading and trailing ends sequentially move past said cross-port.

37. Mechanism as claimed in claim 27 wherein said supply port has leading and trailing ends that are in spaced parallel relationship to each other and are parallel to the longitudinal axis of said actuator support member, and wherein the depth of said supply port in the radial direction from the axis of said actuator support member increases from said leading end to said trailing end such that the rate of flow of fluid into said supply port from said cross-port increases as the second member is rotated in a direction such that said leading and trailing ends sequentially move into registry with said cross-port.

38. Mechanism as claimed in claim 5 wherein said actuator support member is transverse to the longitudinal axis of said actuator.

39. Mechanism as claimed in claim 38 wherein said second member is rotatably mounted on said actuator support member about an axis transverse to the longitudinal axis of said actuator support member, but is otherwise secured against movement with respect to said actuator support member.

40. Mechanism as claimed in claim 39 wherein said first member is engaged with said valve operator in such a manner as to restrain said first member against rotation with respect to said second member.

41. Mechanism as claimed in claim 4 further including a supply passage in said actuator support member for connection with a source of fluid.

42. Mechanism as claimed in claim 41 wherein said second member extends transversely through said actuator support member, and wherein said supply and exhaust ports includes a supply port in said second member extending along the longitudinal axis thereof with one end communicating with said fluid chamber, and further including a cross-port in said second member connecting said supply passage with said supply port.

43. Mechanism as claimed in claim 42 wherein said cylindrical side wall of said first member has a free edge spaced from the end wall thereof, and wherein said supply and exhaust ports includes at least one exhaust port in the form of an open-sided groove extending from said free edge toward said end wall of said first member to a bottom edge.

44. Mechanism as claimed in claim 43 further including a vent port formed in said second member and having an inlet end at the inner end of said second member that communicates with said fluid chamber, and an outlet end that communicates with the outer surface of said second member, the bottom edge of said exhaust port in said exhaust position of said members uncovering said outlet end of said vent port.

45. Mechanism as claimed in claim 44 wherein said exhaust port has a control side edge having an outer end at the free edge of said cylindrical side wall and an inner edge at the bottom edge of said groove, said inner end being spaced from said outer end along the circumference of said cylindrical side wall, said outlet end of said vent port being offset from the bottom edge of said exhaust port in the supply position of said members in the direction of the outer end of said control side edge so that said outlet end will be uncovered by said control edge to limit the expansion of said chamber and hence the extended length of said actuator an amount determined by the angular position of said first and second members with respect to each other.

46. Mechanism as claimed in claim 45 wherein said control side edge is stepped between said inner and outer ends.

47. Mechanism as claimed in claim 46 further including a support bracket, said actuator support member being mounted on said support bracket for rotation about the longitudinal axis of said actuator support member to cause swinging movement of said actuator.

48. Mechanism as claimed in claim 47 wherein said valve operator is curved with a radius of curvature having its center at the axis of rotation of said actuator support member, said first member being slidably engaged with said valve operator to move toward and away from said valve operator support member in response to rotation of said actuator support member.

49. Mechanism as claimed in claim 48 further including a slot and groove connection between said first member and said valve operator to prevent rotation of said first member with respect to said valve operator and with respect to said second member.

50. Mechanism as claimed in claim 46 further including a support bracket, and wherein said actuator support member is slidably mounted on said support bracket such that said first member slides along the length of said valve operator toward and away from said valve operator support member in response to sliding movement of said actuator support member with respect to said bracket.

51. Mechanism as claimed in claim 50 further including a slot and groove connection between said first member and said valve operator to prevent rotation between said first member and said valve operator.

52. An internal combustion engine comprising a plurality of cylinders defining combustion chambers; a cylinder head; a plurality of cylinder head ports formed in said cylinder head each of which communicates with one of said cylinders; a plurality of poppet valves mounted on said cylinder head corresponding in number to said cylinder head ports and each of which controls one of said cylinder head ports; a plurality of valve operating mechanisms corresponding in number to said poppet valves, each of said valve operating mechanisms including an actuator support member on said cylinder head, an extendable and retractable fluid actuator mounted on said actuator support member and having first and second members telescopically engaged with each other, said members being movable between extended and retracted positions with respect to each other in response to fluid flow into and out of said actuator, said first and second members being rotatable with respect to each other between supply and exhaust positions to cause said actuator to extend and retract, respectively, when said actuator is connected with a source of fluid, a valve operator support member spaced from said actuator support member, a valve operator supported on said valve operator support member and engaged with one of said poppet valves, said valve operator being movable with respect to said valve operator support member in poppet valve opening and poppet valve closing directions; said actuator being engaged with said valve operator such that said valve operator is movable in said poppet valve opening and poppet valve closing directions in response to extension and retraction, respectively, of said actuator; a hydraulic circuit including a tank for containing hydraulic fluid, a main supply conduit connected with each fluid actuator of each valve operating mechanism, a pump having its intake side connected with said tank and its output side connected with said main supply conduit for supplying hydraulic fluid under pressure to said valve operating mechanisms, and a drain conduit for returning hydraulic fluid from said cylinder head to said tank.

53. An engine as claimed in claim 52 wherein said valve operator support member comprises a rod mounted on said cylinder head, and wherein each of said valve operators is pivotally supported on said rod.

54. An engine as claimed in claim 52 wherein said actuator support member projects upwardly from said cylinder head with its lower end mounted in said cylinder head; and wherein said first and second members of said actuator are mounted on said actuator support member in coaxial relationship therewith.

55. An engine as claimed in claim 52 further including upright wall means projecting from said cylinder head, and wherein said actuator support member is mounted on said upright wall means in spaced, overhead relationship with respect to said cylinder head such that said actuator depends from said actuator support member toward said cylinder head.

56. An engine as claimed in claim 54 wherein said actuator support member is movably mounted on said upright wall means to permit movement of said actuator along the length of the valve operator.

57. An engine as claimed in claim 56 wherein said actuator support member is slidably mounted on said upright wall means.

58. An engine as claimed in claim 56 wherein said actuator support member is rotatably mounted in said upright wall means.

59. An engine as claimed in claim 58 wherein said valve operator is curved between said valve operator support member and its associated poppet valve such that said actuator is movable along the length of the valve operator upon rotation of said actuator support member in said upright wall means.

60. A cylinder head for an internal combustion engine comprising: a cylinder head body; a plurality of cylinder head ports formed in said cylinder head body; a plurality of poppet valves mounted on said cylinder head corresponding in number to said cylinder head ports; a plurality of poppet valves mounted on said cylinder head corresponding in number to said cylinder head ports and each of which controls one of said cylinder head ports; a plurality of valve operating mechanisms corresponding in number to said poppet valves, each of said valve operating mechanisms including an actuator support member on said cylinder head, an extendable and retractable fluid actuator mounted on said actuator support member and having first and second members telescopically engaged with each other, said members being movable between extended and retracted positions with respect to each other in response to fluid flow into and out of said actuator, said first and second members being rotatable with respect to each other between supply and exhaust positions to cause said actuator to extend and retract, respectively, when said actuator is connected with a source of fluid, a valve operator support member mounted on said cylinder head body and spaced from said actuator support member, a valve operator supported on said valve operator support member and engaged with one of said poppet valves, said valve operator being movable with respect to said valve operator support member in poppet valve opening and poppet valve closing directions; said actuator being engaged with said valve operator such that said valve operator is movable in said poppet valve opening and poppet valve closing directions in response to extension and retraction, respectively, of said actuator.

61. An internal combustion engine comprising: at least one cylinder defining a combustion chamber; a cylinder head overlying said said cylinder; a cylinder head port formed in said cylinder head and communicating with said cylinder; a poppet valve mounted on said cylinder head for controlling said cylinder head port; a support bracket mounted on said cylinder head and having an upright wall projecting from said cylinder head; an actuator support member rotatably mounted in said upright wall; an actuator mounted on said actuator support member, said actuator being extendable and retractable in a direction transverse to the axis of rotation of said actuator support member; a valve operator support member supported in fixed relationship with respect to said poppet valve; a valve operator pivotally supported on said valve operator support member and engaged with said poppet valve; said actuator being engaged with said valve operator to cause said valve operator to move in valve opening and valve closing directions in response to extension and retraction of said actuator.

62. An engine as claimed in claim 61 wherein said actuator includes a control valve operable to control flow of hydraulic fluid into and out of said actuator to cause extension and retraction thereof, and further including a hydraulic system for supplying said actuator with hydraulic fluid in accordance with the position of said control valve.

63. An engine as claimed in claim 62 wherein said hydraulic system includes a pump, an accumulator connected with the output side of said pump, a main supply conduit connected with said accumulator and the output side of said pump, and a valve between said accumulator and pump normally permitting flow only in the direction from said pump to said accumulator.

64. An engine as claimed in claim 63 further including a starter motor, said last named valve being operatively connected with said starter motor to permit flow from said accumulator into said main supply conduit in response to energization of said starter motor.

* * * * *